US012808113B2

(12) United States Patent
Cescot et al.

(10) Patent No.: US 12,808,113 B2
(45) Date of Patent: Nov. 24, 2026

(54) LAUNDRY WASHING MACHINE EQUIPPED WITH A MICROPARTICLES FILTER DEVICE

(71) Applicant: ELECTROLUX APPLIANCES AKTIEBOLAG, Stockholm (SE)

(72) Inventors: Paolo Cescot, Porcia (IT); Andrea Contarini, Porcia (IT); Carlo Antonio Leone, Porcia (IT); Stefano De Paoli, Porcia (IT); Marco Pessot, Porcia (IT); Simone Trangoni, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 85 days.

(21) Appl. No.: 18/871,414

(22) PCT Filed: Jun. 9, 2022

(86) PCT No.: PCT/EP2022/065720

§ 371 (c)(1),
(2) Date: Dec. 3, 2024

(87) PCT Pub. No.: WO2023/237199

PCT Pub. Date: Dec. 14, 2023

(65) Prior Publication Data

US 2025/0354321 A1 Nov. 20, 2025

(51) Int. Cl.

| | |
|---|---|
| ***D06F 39/10*** | (2006.01) |
| ***D06F 39/08*** | (2006.01) |
| ***D06F 39/12*** | (2006.01) |

(52) U.S. Cl.

CPC ..... *D06F 39/10* (2013.01); *D06F 39/085* (2013.01); *D06F 39/12* (2013.01)

(58) Field of Classification Search

CPC ..... D06F 39/10

See application file for complete search history.

(56) References Cited

U.S. PATENT DOCUMENTS

2021/0180240 A1 6/2021 Kim et al.

FOREIGN PATENT DOCUMENTS

CN 204185692 U 3/2015
DE 10 2019 216696 A1 5/2021

(Continued)

OTHER PUBLICATIONS

International Search Report and Written Opinion dated Jan. 30, 2023 of International Application No. PCT/EP2022/065720.

*Primary Examiner* — Jason Y Ko

(74) *Attorney, Agent, or Firm* — Chrisman Gallo Tochtrop LLC

(57) ABSTRACT

A laundry washing machine including an outer cabinet, a washing tub containing a washing drum, a liquid supply system, a draining system. A filtering group assembly (30; 230) is arranged in a flow path between the liquid supply system and the draining system and including a housing body, an inlet, a microparticles filter device including a first filtering chamber housed in the housing body, the first filtering chamber including a microparticles filter element having a filtering surface, a main outlet. A cleaning device is movably arranged in the first filtering chamber for moving microparticles removed from the filtering surface towards a storage volume of a collecting chamber arranged at a side of the first filtering chamber and in communication therewith. The filtering group assembly includes an objects filter device including a second filtering chamber housed in the housing body, the second filtering chamber including an objects filter element for stopping objects contained in the liquid to be filtered when the liquid flows therethrough.

20 Claims, 17 Drawing Sheets

(56) References Cited

FOREIGN PATENT DOCUMENTS

| | | | |
|---|---|---|---|
| EP | 3907322 | A1 | 11/2021 |
| GB | 2588376 | A | 4/2021 |
| JP | 2006102346 | A | 4/2006 |
| JP | 2009089947 | A | 4/2009 |
| KR | 20210125178 | A | 10/2021 |
| WO | 2019081013 | A1 | 5/2019 |
| WO | 2020089727 | A1 | 5/2020 |

LAUNDRY WASHING MACHINE EQUIPPED WITH A MICROPARTICLES FILTER DEVICE

CROSS-REFERENCE TO RELATED APPLICATIONS

This is a national phase application under 35 U.S.C. § 371 of International Application No. PCT/EP2022/065720, filed Jun. 9, 2022, the entire disclosure of which is incorporated by reference herein.

FIELD OF THE INVENTION

The present invention concerns the field of laundry washing techniques.

Specifically, the invention relates to a laundry washing machine equipped with a microparticles filter device.

BACKGROUND ART

Nowadays the use of laundry washing machines, both "simple" laundry washing machines (i.e. laundry washing machines which can only wash, rinse and spin laundry) and laundry washing-drying machines (i.e. laundry washing machines which can also dry laundry by means of a drying airflow), is widespread.

In the present description the term "laundry washing machine" will refer to a simple laundry washing machine or a laundry washing-drying machine.

As known, in laundry washing machine laundry to be washed is received in a rotatable washing drum contained in a washing tub.

It is known that during laundry washing cycles, laundry undergoes to mechanical and/or chemical treatments inside the washing drum with the use of a washing liquor, typically water with the possible addition of washing/rinsing products such as detergent, softener, rinse conditioner, etc.

Laundry to be treated in a laundry washing machine typically comprises clothes and linens made of natural or synthetic fabrics. During washing and/or rinsing treatments, laundry loses tiny particles, called microparticles or microfibers. In particular, clothes comprising synthetic materials lose tiny plastic particles fibres, called microplastics, which are non-biodegradable.

Microparticles/microplastics end up in the wastewater drained from the laundry washing machine and eventually end up in the environment contributing to environmental pollution. For example, microplastics washed off from laundry greatly contribute to plastic that is polluting seas and oceans.

Different solutions have been proposed in known laundry washing machines by arranging a microparticles filter to capture microparticles and reduce their drainage in the wastewater.

In a first type of known systems, the microparticles filter is placed outside the machine along the draining hose that is connected to a drainage point.

In different embodiments of known systems, the microparticles filter is placed along a proper hydraulic line inside the machine.

A first known system for microparticles filtration used in laundry washing machine is disclosed in WO2020089727A1. Here an assembly comprising a microparticles filter group is positioned along a drainage hose and a filter body houses the filter group. The assembly is made in cylindrical shape and is insertable/removable as a cartridge through an opening made on an outer washing machine wall to allow maintenance and replacement operations of the filter group.

The filter group comprises a cylindrically shaped filter medium for synthetic microfibers and, according to a preferred embodiment, it further comprises a safety pre-filter fluidically positioned upstream of the filter medium. The pre-filter is arranged internally and coaxially to said filter medium.

A second known system for microparticles filtration used in a laundry washing machine is disclosed in WO2019081013A1. Here a microparticles filter is arranged along a re-circulation line that takes liquid from the bottom of the washing tub and conveys the same in an upper point of the same washing tub.

The microparticles filter comprises a filtering element, or filter membrane, arranged in a filtering chamber of the filter. According to some embodiments disclosed therein, a cleaning device is movably arranged in the filtering chamber for removing microparticles that accumulate on the filter membrane.

Microparticles removed from the filter membrane by the cleaning device are pushed towards a microparticles collecting chamber arranged at a side of the filtering chamber and separated therefrom. Removed microparticles enter the microparticles collecting chamber through an opening closed by a controllable flap. The collecting chamber is then accessible from outside to a user via a door realized on the outer cabinet of the machine so that it can be removed manually.

It is an aim of the present invention to optimize a filtering system in a laundry washing machine.

It is an object of the invention to provide a laundry washing machine that reduces constructional complexity of filtering system equipping the machine.

It is another object of the present invention to provide a solution that makes maintenance operations of the laundry washing machine more comfortable compared to known system.

A further object of the present invention is to provide a solution that allows maintenance of filtering element/s, such as cleaning or replacing operations of the filtering element/s.

Another object of the present invention is to develop a filtering system in a laundry washing machine that assures easy accessibility to the filtering elements during maintenance.

DISCLOSURE OF INVENTION

In a first aspect thereof the present invention relates, therefore, to a laundry washing machine comprising:

- an outer cabinet;
- a washing tub containing a washing drum suited to receive the laundry to be washed;
- a liquid supply system suitable to convey liquid to said washing tub;
- a draining system to drain liquid outside said cabinet;
- a filtering group assembly arranged in a flow path between said liquid supply system and said draining system, said filtering group assembly comprising:
- a housing body;
- an inlet for liquid to be filtered;
- a microparticles filter device comprising a first filtering chamber housed in said housing body, said first filtering chamber comprising a microparticles filter element having a filtering surface on which microparticles accumulate while said liquid flows therethrough;

a main outlet for filtered liquid hydraulically communicating with said first filtering chamber;

a cleaning device movably arranged in said first filtering chamber for removing microparticles that accumulate on said filtering surface, said cleaning device moving microparticles removed from said filtering surface towards a storage volume of a collecting chamber arranged at a side of said first filtering chamber and in communication therewith;

wherein said filtering group assembly comprises an objects filter device comprising a second filtering chamber housed in said housing body, said second filtering chamber comprising an objects filter element for stopping objects contained in said liquid to be filtered when said liquid flows therethrough, wherein said objects filter device is provided in a position opposite to said collecting chamber and located between said inlet and said microparticles filter device, said second filtering chamber receiving a portion of said cleaning device therein.

Advantageously, by arranging the objects filter device opposite to the collecting chamber, the filtering group assembly can have room in its internal volume defined by the housing body for placing the cleaning device that interacts with the microparticles filter element to remove microparticles therefrom. Furthermore, the collecting chamber, which is supposed to be removed from the laundry washing machine more frequently than what can be foreseen for the objects filter device, it is possible to arrange such collecting chamber in a comfortable position for a user interacting with it at a front side wall of the laundry washing machine.

Still advantageously, by arranging the objects filter device opposite to the collecting chamber, a wide area is created on the filtering group assembly to place a plurality of liquid inlet and outlets thereby efficiently designing the liquid flows through the filtering group assembly, saving energy needed to power the pumping means for moving such liquid flows.

Then, advantageously, by providing a portion of the cleaning device received in the second filtering chamber of the objects filter device it is possible to use more efficiently the space available inside the housing body.

In addition, the presence of a cleaning device portion in the second filtering chamber enhances the possibility that the objects filter device can efficiently block objects preventing them to reach a downstream portion of a draining circuit, for example a pumping device arranged downstream the filtering group assembly.

Preferably, the microparticles filter device is completely arranged inside the outer cabinet of the laundry washing machine.

According to a preferred embodiment of the invention, the microparticles filter device is a filter suitable to filter particles having a minimum dimension comprised between 0.1 μm and 5 mm, preferably a minimum dimension comprised between 10 μm and 100 μm, more preferably a minimum dimension comprised between 10 μm and 75 μm.

Advantageously, the microparticles filter device is suitable to retain particles present in the waste liquid produced by mechanical and/or chemical treatments of the laundry inside the washing drum, preferably tiny plastic particles released by the laundry, also indicated as microplastics, which are non-biodegradable.

Preferably, the objects filter device is a filter suitable to filter objects having a maximum dimension higher than 5 mm.

In a preferred embodiment, the filtering group assembly is arranged in the draining system.

Advantageously, the liquid is subjected to a filtration process preventing microparticles leaving the laundry washing machine before the liquid reaches a drainage point outside the machine.

According to a preferred embodiment of the invention, the liquid supply system includes at least one recirculation system for draining liquid from a bottom region of the washing tub to a second region of the washing tub, said at least one recirculation system comprising a recirculation pump arranged downstream the filtering group assembly and the filtering group assembly comprising a further outlet apt to be connected to the recirculation pump.

Preferably, the further outlet hydraulically communicates with the second filtering chamber.

In a preferred embodiment, the collecting chamber is configured to be removably coupled with respect to the housing body.

Preferably, the cleaning device comprises at least a portion extending into the storage volume of the collecting chamber thereby providing an extraction aid member to remove the cleaning device from the housing body when the collecting chamber is removed from the housing body.

Advantageously, the collecting chamber, when coupled with the housing body of the microparticles filter device, closes an opening, which is provided in said housing body, through which, or by means of which, an extraction aid member can be reached by a user to remove the cleaning device from the housing body. In one embodiment, the extraction aid member can be removed from the housing body by passing the cleaning device through said opening.

In a preferred embodiment, the collecting chamber is embodied as a cap for closing an opening provided in the housing body.

In a preferred embodiment, the portion of the cleaning device extending into the storage volume, provided in said collecting chamber to accumulate microparticles, occupies a volume portion of the storage volume ranging from 2% to 30%, or 25% or 20% or 15% or 10% or 8% or 5% of the overall storage volume. The volume portion occupied by the portion of the cleaning device extending into said storage volume is dimensioned according to the microparticles accumulation capacity that has to be assigned to the microparticles filter device, taking also into account the free space available within the outer cabinet of a laundry treating machine and the resulting size of the microparticles filter device. This has beneficial advantages on increasing the number of laundry treatments that the machine can perform without emptying the collecting chamber.

In an embodiment of the invention, the cleaning device extends into the storage volume of said collecting chamber, along an extension direction which is ranging from 15% to 100% of the storage volume extension along the same direction.

In an embodiment of the invention wherein the cleaning device extends into the storage volume of the collecting chamber along an extension direction which is lower than 100% of the storage volume extension along the same direction, the cleaning device has a cantilever end portion inside the storage volume, i.e. inside the collecting chamber.

Advantageously, when the collecting chamber is removed from the housing body the portion of the cleaning device extending into the collecting chamber may be used as an extraction aid member to remove the cleaning device. After removal of the cleaning device, the microparticles filter element is advantageously accessible for a proper cleaning process.

In a preferred embodiment, the microparticles filter element is removably arranged in the first filtering chamber.

Advantageously, the microparticles filter element may be extracted out from the first filtering chamber and from the housing body for a proper cleaning process or substitution, if necessary.

Further advantageously, the microparticles filter element may be extracted out from the filtering chamber and from the housing body through an opening provided in the housing body.

In one embodiment the same opening provided in the housing body allows the extraction of the cleaning device and the microparticles filter element from the housing body.

In a preferred embodiment, the objects filter element of the objects filter device is removably arranged in the second filtering chamber.

Advantageously, the objects filter element may be extracted out from the second filtering chamber and from the housing body for a proper cleaning process or substitution, if necessary.

According to a preferred embodiment of the invention, the cleaning device is configured to be removably coupled to the first filtering chamber and the second filtering chamber.

Advantageously, the cleaning device may be extracted out from the first and second filtering chambers so that the microparticles filter element and the objects filter element are advantageously accessible from outside. A user may hence advantageously reach the microparticles and/or the filter element objects for a proper cleaning process.

In a preferred embodiment, the cleaning device comprises a rotatable element apt to remove microparticles that accumulate on the filtering surface of the microparticles filter element.

According to a preferred embodiment of the invention, the rotatable element comprises a worm comprising a central shaft body and a helix-shaped element winding around the central shaft body.

Advantageously, the rotatable element wipes a side of the filtering surface of the microparticles filter element and moves microparticles towards the collecting chamber, acting as a worm conveyor.

According to a preferred embodiment of the invention, an actuating device is provided for moving the cleaning device.

In a preferred embodiment, the actuating device comprises an electric motor.

Preferably, the actuating device is provided in a position opposite to the collecting chamber.

Advantageously, the actuating device can be arranged at an opposite end portion of the housing body so as to be closer to its power supply and far from user interaction area.

According to a preferred embodiment of the invention, the cleaning device and the collecting chamber are removably coupled one another, so that when the collecting chamber is removed from the housing body the collecting chamber is disconnected from the cleaning device.

In a preferred embodiment, the outer cabinet of the machine further comprises an aperture so that the collecting chamber of the microparticles filter device is accessible therefrom. The outer cabinet then further comprises an openable door associated to the aperture.

In a preferred embodiment, the microparticles filter element is a disposable filter element.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular.

DETAILED DESCRIPTION OF PREFERRED EMBODIMENTS OF THE INVENTION

Figure 1:
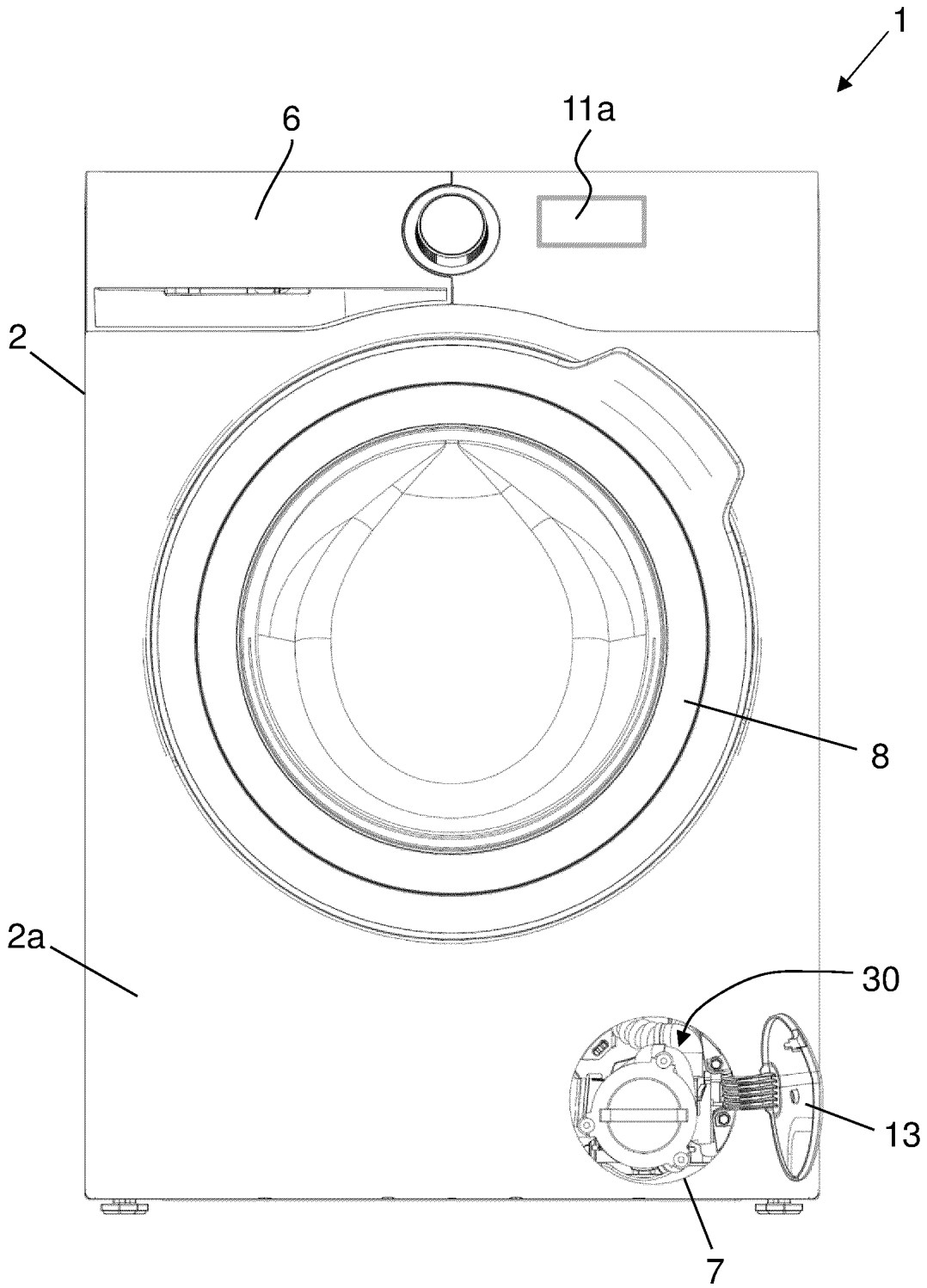
FIG. 1 shows a frontal view of a laundry washing machine according to a first embodiment of the invention.
Figure 2:
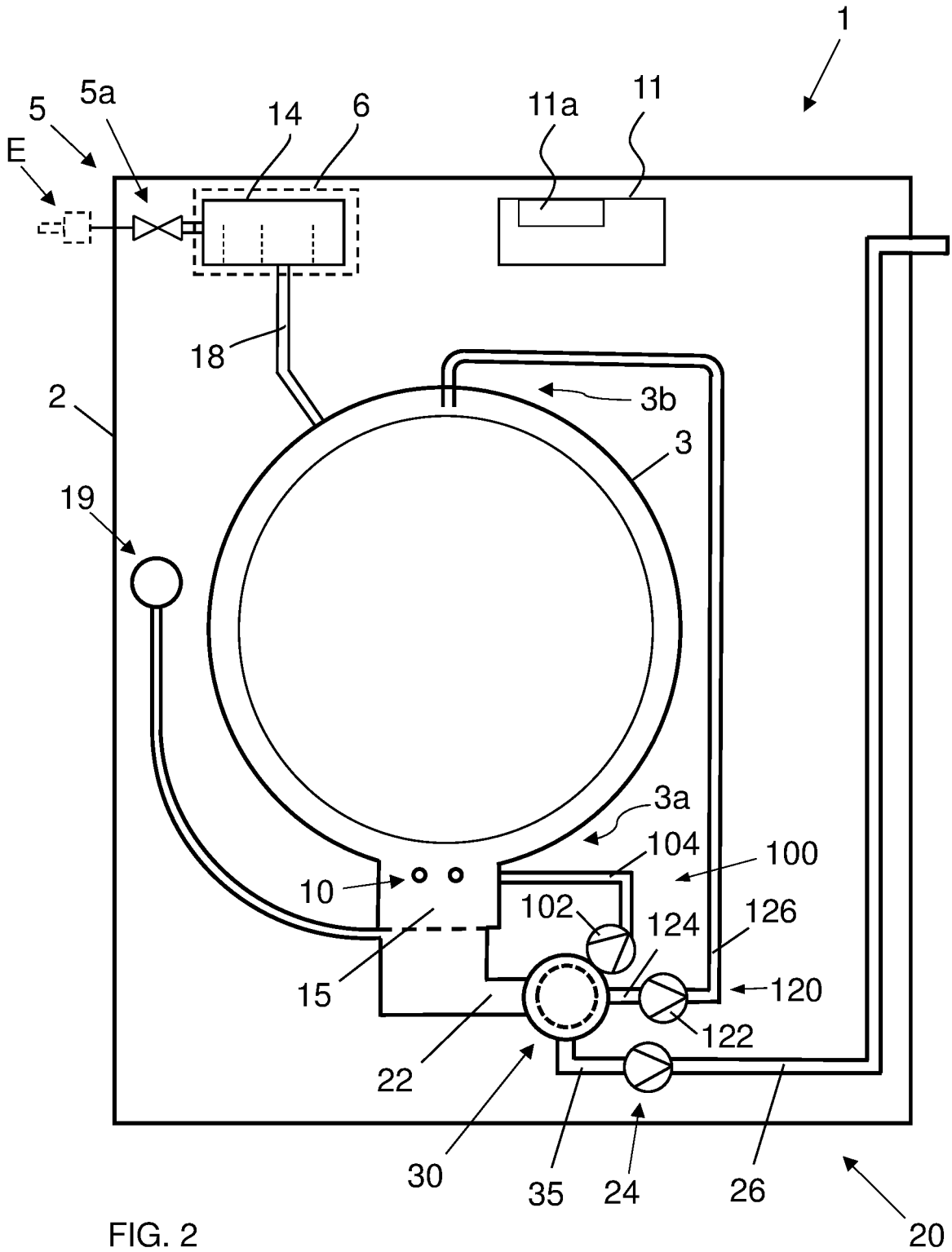
FIG. 2 shows a schematic view of the laundry washing machine of FIG. 1.
Figure 3:
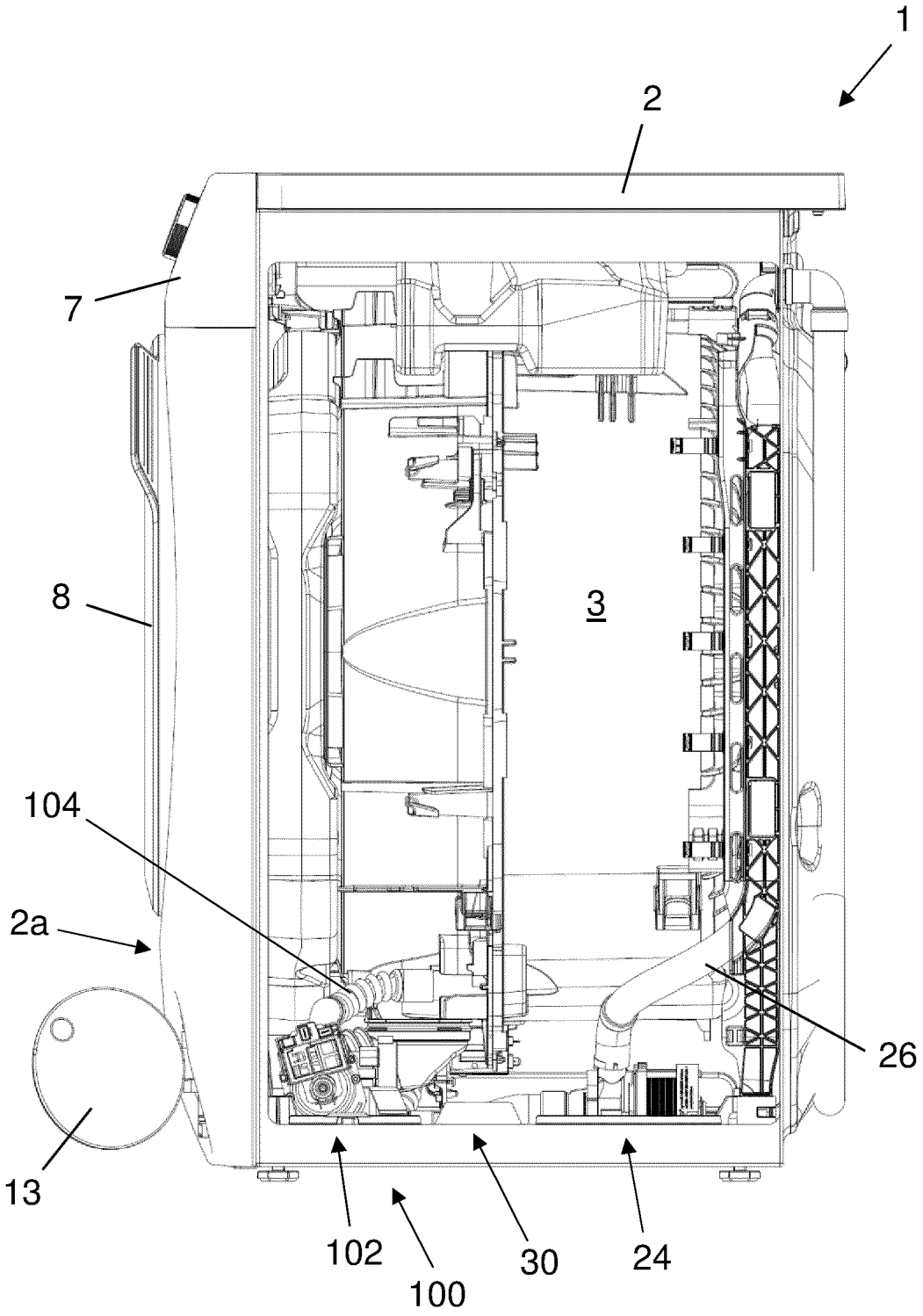
FIG. 3 shows a lateral view of the laundry washing machine of FIG. 1 with an external side wall removed therefrom.
Figure 4:
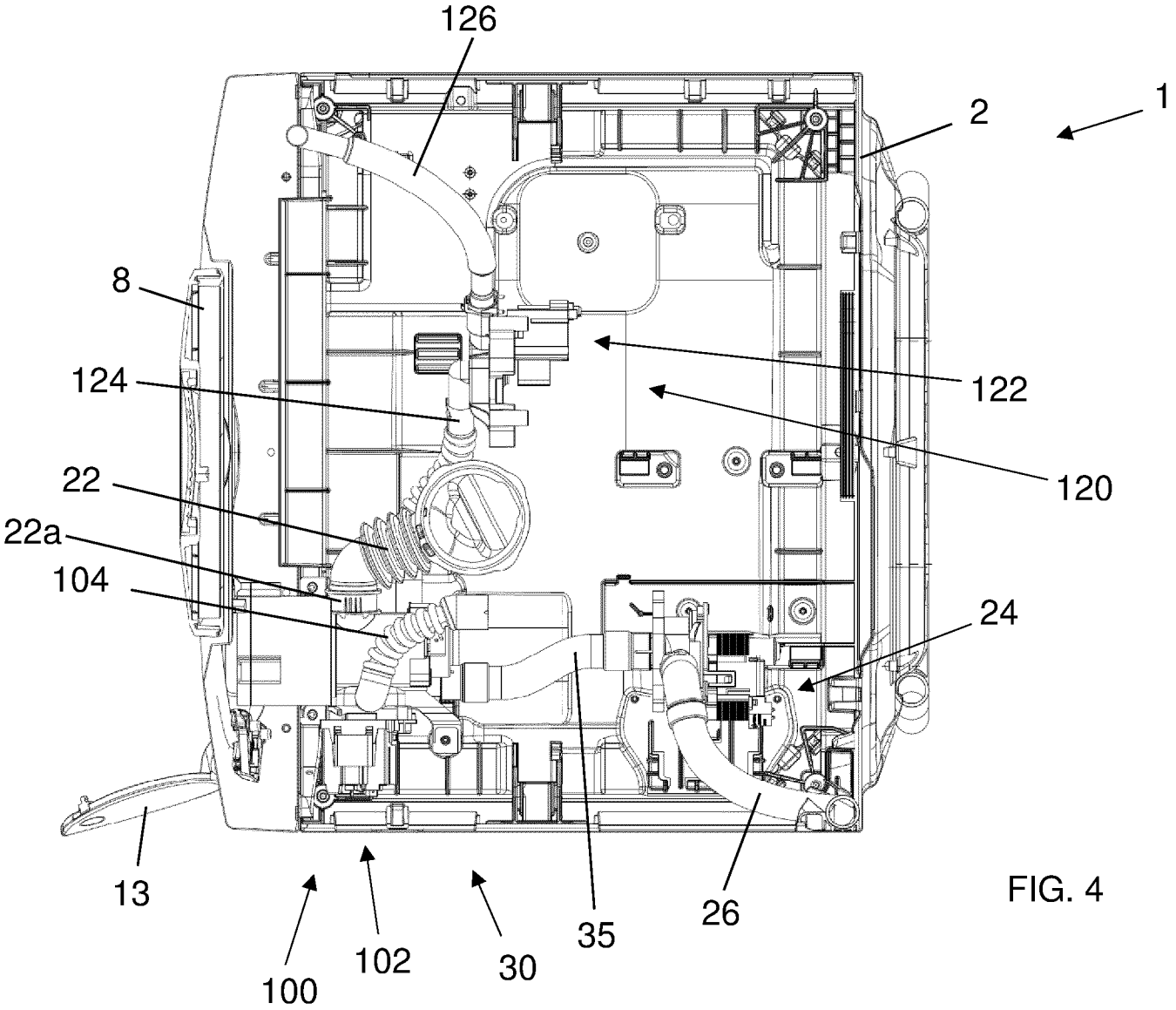
FIG. 4 shows a view from above of the laundry washing machine of FIG. 1 with the top side wall and some components removed therefrom.
Figure 5:
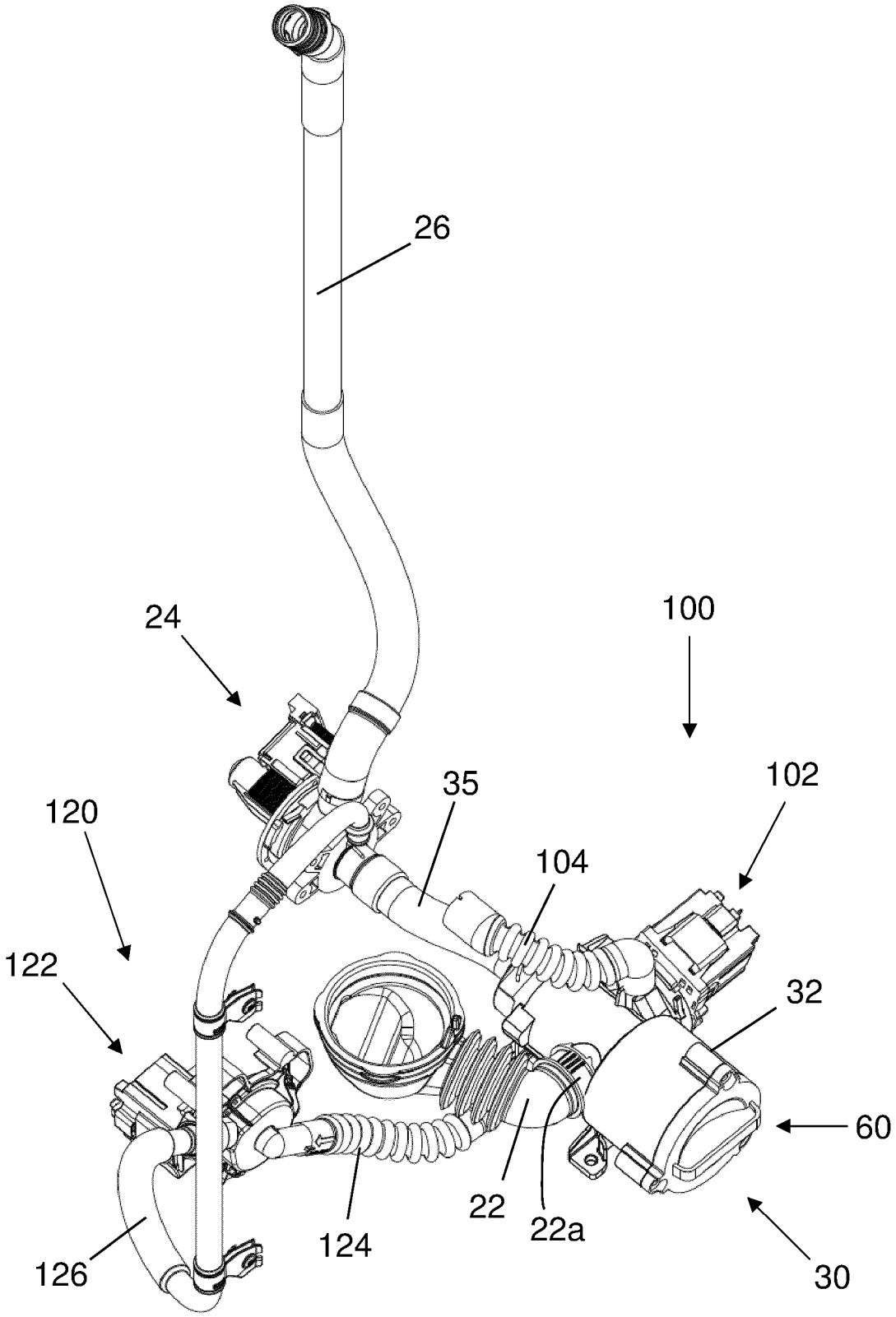
FIG. 5 shows an isometric view of internal components of the laundry washing machine of FIG. 1 isolated from the rest of the machine.
Figure 6:
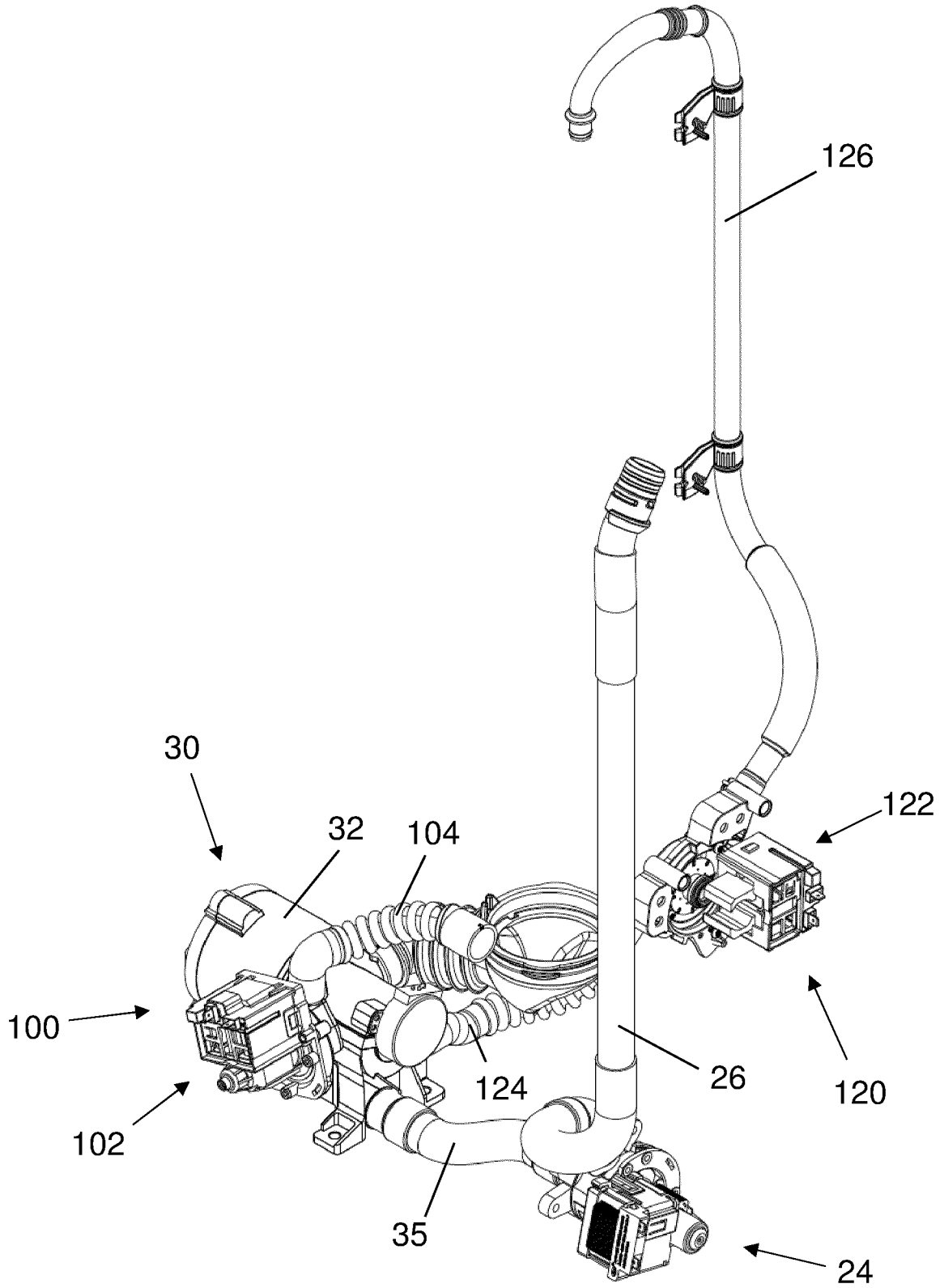
FIG. 6 shows the components of FIG. 5 from another point of view.
Figure 7:
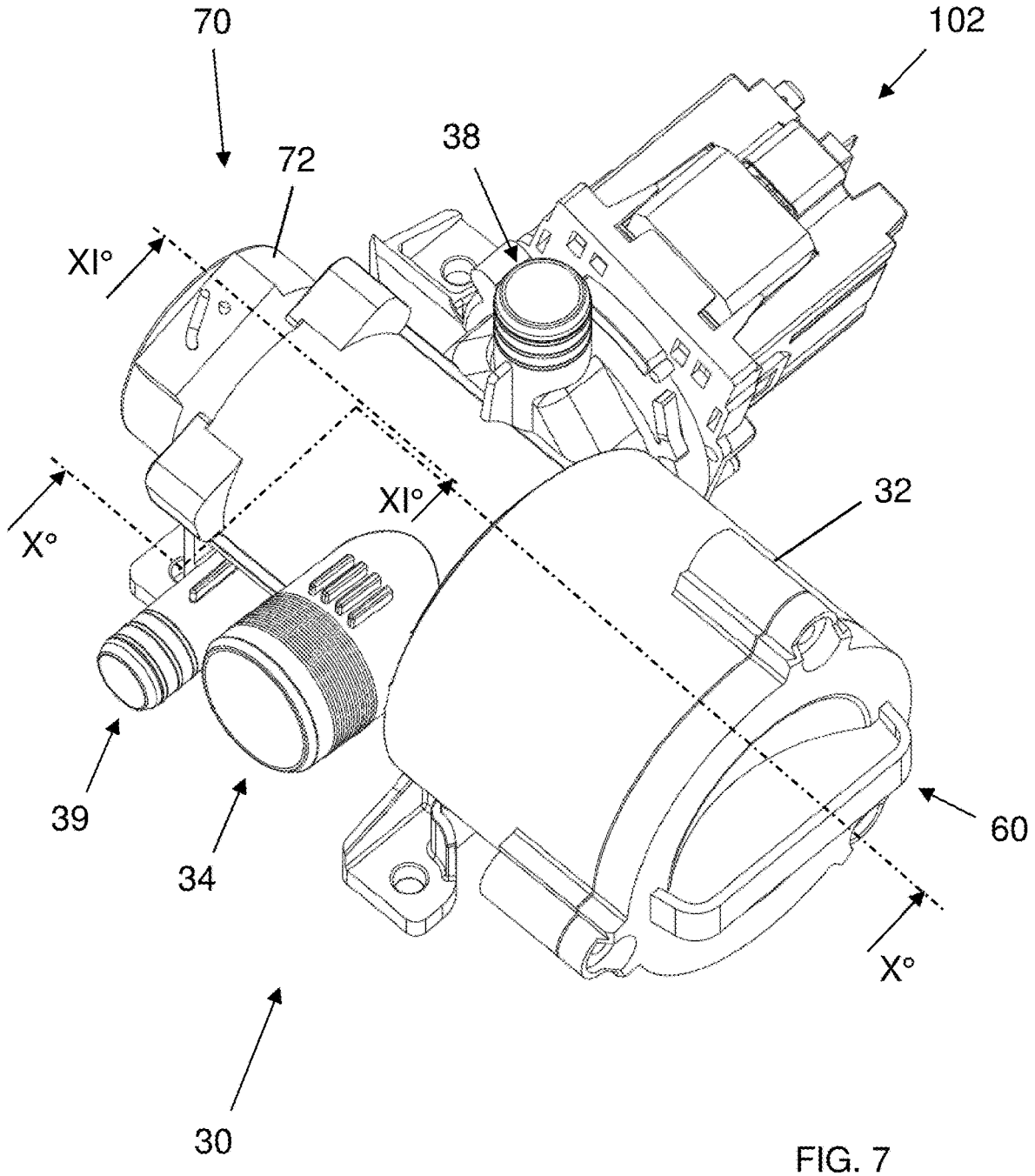
FIG. 7 shows some components of FIG. 5, isolated from the rest of the machine, comprising a filtering group assembly according to a preferred embodiment of the invention.
Figure 8:
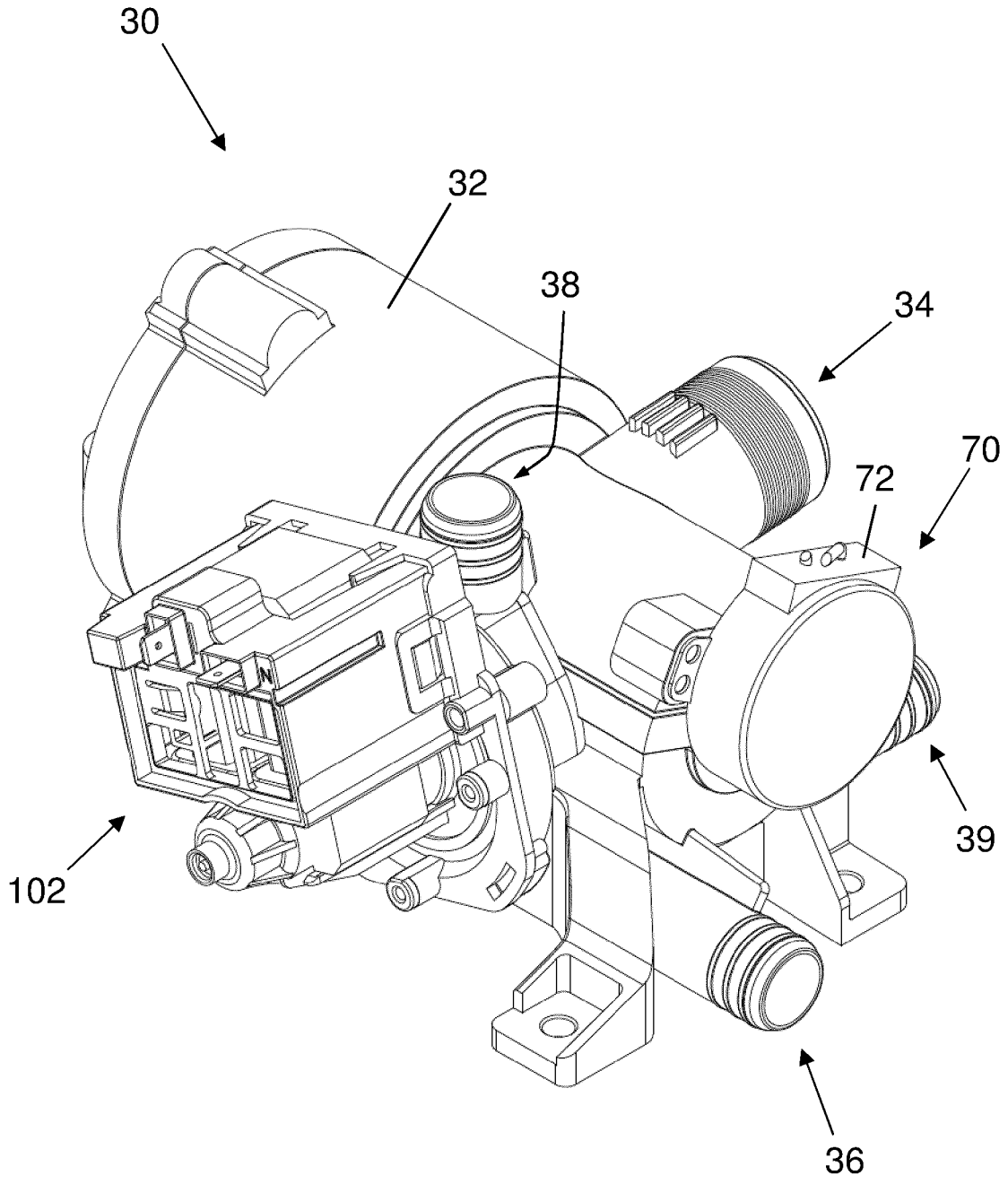
FIG. 8 shows the components of FIG. 7 from another point of view.

As described below, the present invention has proved to be particularly advantageous when applied to laundry washing machines, i.e. appliances able to carry out at least a washing process on laundry and optionally further able to perform a drying process on laundry. In this view the present invention can be applied to laundry washing and drying machines.

With reference to FIGS. 1 to 4, a preferred embodiment of a laundry washing machine 1 according to the invention is described.

The laundry washing machine 1 preferably comprises an external casing or outer cabinet 2, a washing tub 3, a container 4, preferably a perforated washing drum 4, where the laundry to be treated can be loaded.

The washing tub 3 and the washing drum 4 both preferably have a substantially cylindrical shape.

The cabinet 2 at its front side wall 2*a* is provided with a loading/unloading door 8 which allows access to the washing drum 4.

The washing drum 4 is advantageously rotated by an electric motor, as known in the art, which preferably transmits the rotating motion to the shaft of the washing drum 4, advantageously by means of a belt/pulley system. In a different embodiment of the invention, the motor can be directly associated with the shaft of the washing drum 4.

The washing drum 4 is advantageously provided with holes or apertures which allow the liquid flowing therethrough. Said holes are typically and preferably homogeneously distributed on the cylindrical side wall of the washing drum 4.

The bottom region 3*a* of the washing tub 3 preferably comprises a seat 15, or sump, suitable for receiving a heating device 10. The heating device 10, when activated, heats the liquid collected inside the sump 15.

In further embodiments, other type of heating device may be advantageously placed in the machine 1 to heat liquid.

Preferably, the laundry washing machine 1 comprises a device 19 suited to sense (or detect) the liquid level inside the washing tub 3.

The sensor device 19 preferably comprises a pressure sensor which senses the pressure in a chamber formed in, or connected to, the washing tub 3. Such chamber can be partially filled by the liquid contained in the washing tub 3, thereby modifying the pressure in the unfilled portion of said chamber. From the pressure values sensed by the sensor device 19 it is possible to determine the liquid level of the liquid inside the washing tub 3. In another embodiment, not illustrated, laundry washing machine may preferably comprise (in addition to or as a replacement of the pressure sensor) a level sensor (for example mechanical, electromechanical, optical, etc.) adapted to sense (or detect) the liquid level inside the washing tub 3.

A liquid (water) supply system 5 is preferably arranged in the upper part of the laundry washing machine 1 and is suited to supply water into the washing tub 3 from an external water supply line E. The water supply system 5 preferably comprises a controlled supply valve 5*a* which is properly controlled, opened and closed, during a washing cycle to properly carry out all the phases thereof. The water supply system of a laundry washing machine is well known in the art, and therefore it will not be described in detail.

Liquid supply system refers, in general, to any system apt to supply water or any liquid into the tub.

The laundry washing machine 1 advantageously comprises a treating agents dispenser 14 to supply one or more treating agents into the washing tub 3 during a washing cycle. Treating agents may comprise, for example, detergents, rinse additives, fabric softeners or fabric conditioners, waterproofing agents, fabric enhancers, rinse sanitization additives, chlorine-based additives, etc.

Preferably, the treating agents dispenser 14 comprises a removable drawer 6 provided with various compartments suited to be filled with the treating agents.

In the preferred embodiment here illustrated, the water is supplied into the washing tub 3 from the water supply system 5 by making it flow through the treating agents dispenser 14 and then through a supply pipe 18. The provision of the treating agents to the washing tub 3 may be performed by automatically dosing an amount of said agents before delivering them to the washing tub 3. Such dosage is preferably performed by a dosing device having metering means for measuring a desired amount of an agent to be taken from a treating agent storage and delivered to the washing tub 3.

In an alternative embodiment of the invention, a further separate water supply pipe can be provided, which supplies exclusively clean water into the washing tub from the external water supply line.

In further preferred embodiments, not illustrated herein, a water softening device may preferably be arranged/interposed between the external water supply line and the treating agents dispenser so as to be crossed by the fresh water flowing from the external water supply line. The water softening device, as known, is structured for reducing the hardness degree of the fresh water drawn from the external water supply line and conveyed to the treating agents dispenser.

In a different embodiment, the water softening device may be arranged/interposed between the external water supply line and the washing tub, so as to be crossed by the fresh water flowing from the external water supply line and conveying it directly to the washing tub.

Laundry washing machine 1 advantageously comprises a control unit 11 which is in signal and/or electrical communication to the various operational parts of the laundry washing machine 1 such as drum motor, sensors, etc., in order to ensure its operation for carrying out a laundry treating program. The control unit 11 is advantageously connected also to an interface unit 11*a* which is accessible to the user and by means of which the user selects and sets the washing parameters from time to time, in particular a desired laundry washing or treating program.

Laundry washing machine 1 preferably comprises a draining system 20 to drain liquid outside the cabinet 2 up to a drainage point (not shown). More preferably the draining system 20 withdraws liquid from the bottom region 3*a* of the washing tub 3 and drains it outside the cabinet 2.

The draining system 20 preferably comprises a main discharging pipe 22 connected to the sump 15, a draining pump 24 and an outlet pipe 26 ending outside the cabinet 2.

Preferably, the draining pump 24 is a centrifugal pump provided with a rotating component, or impeller, that moves the liquid to the pump outlet.

According to a first aspect of the invention, a filtering group assembly 30 is arranged in a flow path between the water supply system 5 and the draining system 20.

Preferably, the filtering group assembly 30 is arranged in the draining system 20.

More preferably, the filtering group assembly 30 is arranged between the main discharging pipe 22 and the draining pump 24.

The filtering group assembly 30 preferably comprises a microparticles filter device 40 for retaining microparticles and an objects filter device 140 for stopping objects having a maximum dimension higher than 5 mm.

The microparticles filter device 40 and the objects filter device 140 preferably extend next to each other within the same body element.

The objects filter device 140 is adapted to stop objects before they reach a pump, for example before they reach the draining pump 24 or other pumps, as better described later. The objects filter device 140 has the aim of retain undesirable objects that may damage a pump, preferably the draining pump 24, for example may damage the impeller in case a centrifugal pump design is used.

Said kind of objects, also indicated hereinafter as coarse material, may comprise, for example, buttons, coins, screws, needles, paper clips, pieces of clothes, etc.

The microparticles filter device 40 is a filter suitable to retain particles having a minimum dimension comprised between 0.1 μm and 5 mm, preferably a minimum dimension comprised between 10 μm and 100 μm, more preferably a minimum dimension comprised between 10 μm and 75 μm.

Particles of this type are typically present in the waste liquid produced by mechanical and/or chemical treatments of the laundry inside the washing drum 4 as tiny particles are released by the laundry. In particular, laundry comprising synthetic materials loses tiny plastic particles fibres, also indicated as microplastics, which are non-biodegradable.

The microparticles filter device 40, therefore, advantageously acts as a microplastics filter device 40.

According to the invention, therefore, the filtering group assembly 30 prevents coarse material to reach the draining pump 24 and liquid is subjected to a filtration process preventing microparticles leaving the laundry washing machine 1 before it reaches the drainage point outside the machine 1.

Liquid flowing through the filtering group assembly 30 and that is discharged to the outside through the draining system 20 is therefore advantageously subjected to the action of at least said microparticles filter device 40, as better described later.

According to the preferred embodiment described with reference to FIGS. 1-6 the laundry washing machine 1 preferably comprises a first recirculation system 100 which is adapted to drain liquid from a bottom region 3*a*, placed at a bottom part of the washing tub 3, and to re-admit such a liquid back again into said bottom region 3*a* of the washing tub 3. The laundry washing machine 1 preferably comprises a second recirculation system 120 which is adapted to drain liquid from said bottom region 3*a* of the washing tub 3 and to re-admit such a liquid into a second region 3*b* of the washing tub 3, placed at a higher level relative to the bottom region 3*a*.

The liquid taken from the washing tub 3 is preferably re-admitted to the bottom region 3*a* of the washing tub 3 for mixing and/or dissolving laundry treating products, in particular detergent in powder or liquid form. Mixing and/or dissolving of a laundry treating product is preferably carried out during a washing cycle when one of the products is supplied into the washing tub 3 from the treating agents dispenser 14.

Preferably, the second region 3*b* of the washing tub 3 substantially corresponds to an upper region 3*b* of the washing tub 3. The liquid is preferably re-admitted to the upper region 3*b* of the washing tub 3 to improve wetting of the laundry inside the washing drum 4. This action is preferably carried out at the beginning of a washing cycle when the laundry needs to be completely soaked. Furthermore, this action is preferably carried out during rinsing phases at the beginning of the washing cycle or during rinsing phases in successive steps of the washing cycle. Furthermore, this action can be also carried out during a main wash phase so as to efficiently reach laundry that rest in an upper region of the drum.

The first recirculation system 100 preferably comprises a first recirculation pump 102 connected downstream the filtering group assembly 30 and a first recirculation line 104 for conveying liquid to the bottom region 3*a* of the washing tub 3.

Preferably, the first recirculation pump 102 is a centrifugal pump provided with a rotating component, or impeller, that moves the liquid to the pump outlet.

The second recirculation system 120 preferably comprises a second recirculation pump 122 connected downstream the filtering group assembly 30, a pipe 124 connecting the filtering group assembly 30 to the second recirculation pump 122 and a second recirculation line 126 for conveying liquid to the second region 3*b* of the washing tub 3. Preferably, the second recirculation pump 122 is a centrifugal pump provided with a rotating component, or impeller, that moves the liquid to the pump outlet.

According to the invention, the filtering group assembly 30 is configured so that the liquid flowing therethrough and that is circulated in the first recirculation system 100 and/or the second recirculation system 120 is preferably subjected to the action of only the objects filter device 140, as better described later. The filtering group assembly 30 is thus preferably configured to prevent coarse material to reach the first recirculation pump 102 and/or the second recirculation pump 122 of the respective recirculation systems 100, 120.

The filtering group assembly 30 is better described in detail with reference to FIGS. 5 to 14.

The filtering group assembly 30 preferably shows an elongated shape and preferably extends along a main axis X.

The filtering group assembly 30 comprises a housing body 32, preferably made of a plastic, i.e. polymeric, material.

According to the preferred embodiment illustrated in the FIGS. 1-4, the filtering group assembly 30 is preferably arranged in the lower part of the laundry washing machine 1, more preferably in the lower right side of the laundry washing machine 1.

The filtering group assembly 30 is preferably placed just below the sump 15 and connected thereto by means of said main discharging pipe 22.

An inlet 34 of the filtering group assembly 30 is connected to an end 22*a* of the main discharging pipe 22.

The filtering group assembly 30 then comprises a main outlet 36 for filtered liquid that is connected to the draining pump 24, preferably through a connecting pipe 35.

Figure 9:
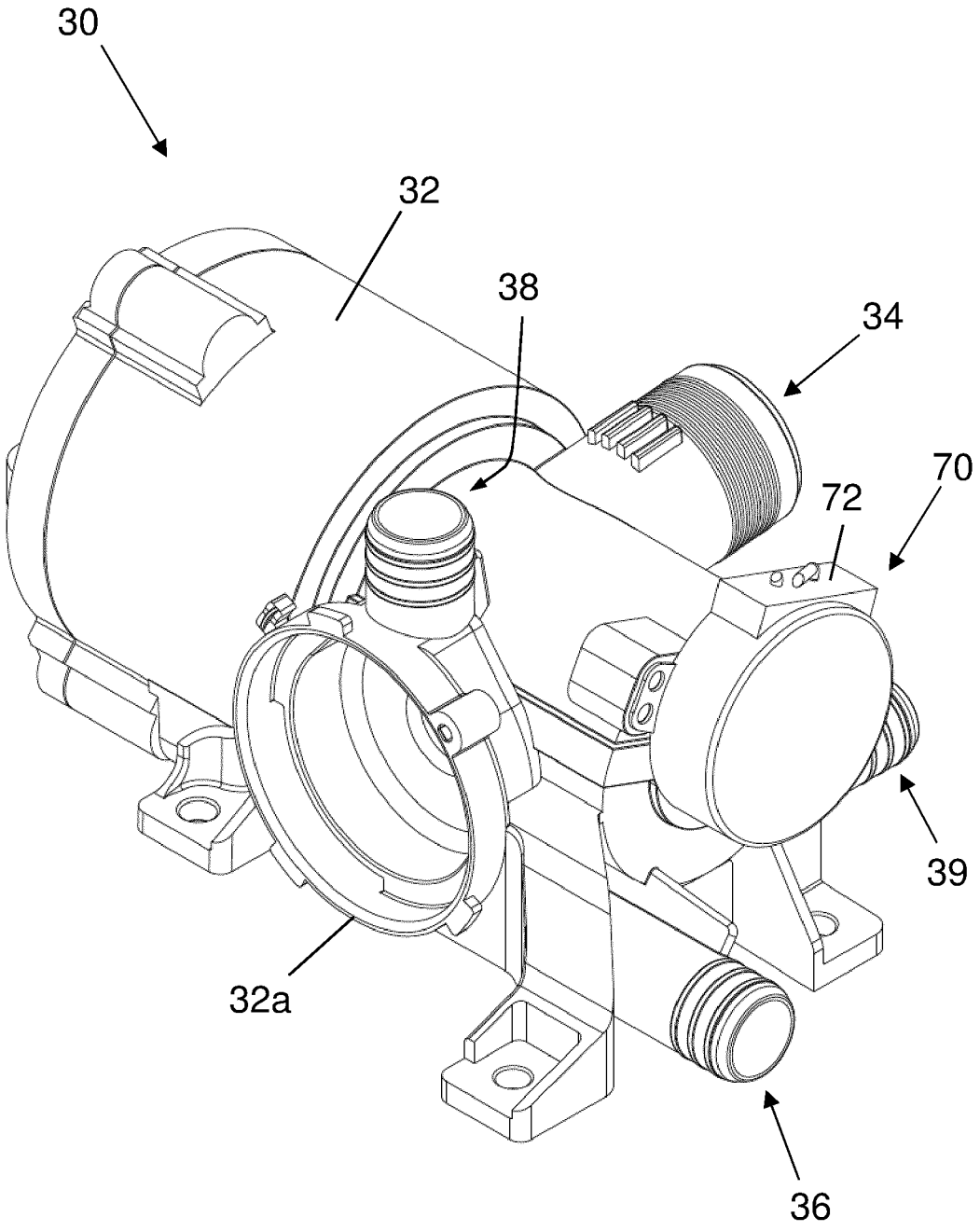
FIG. 9 shows the components of FIG. 8 with a component removed therefrom.
Figure 10:
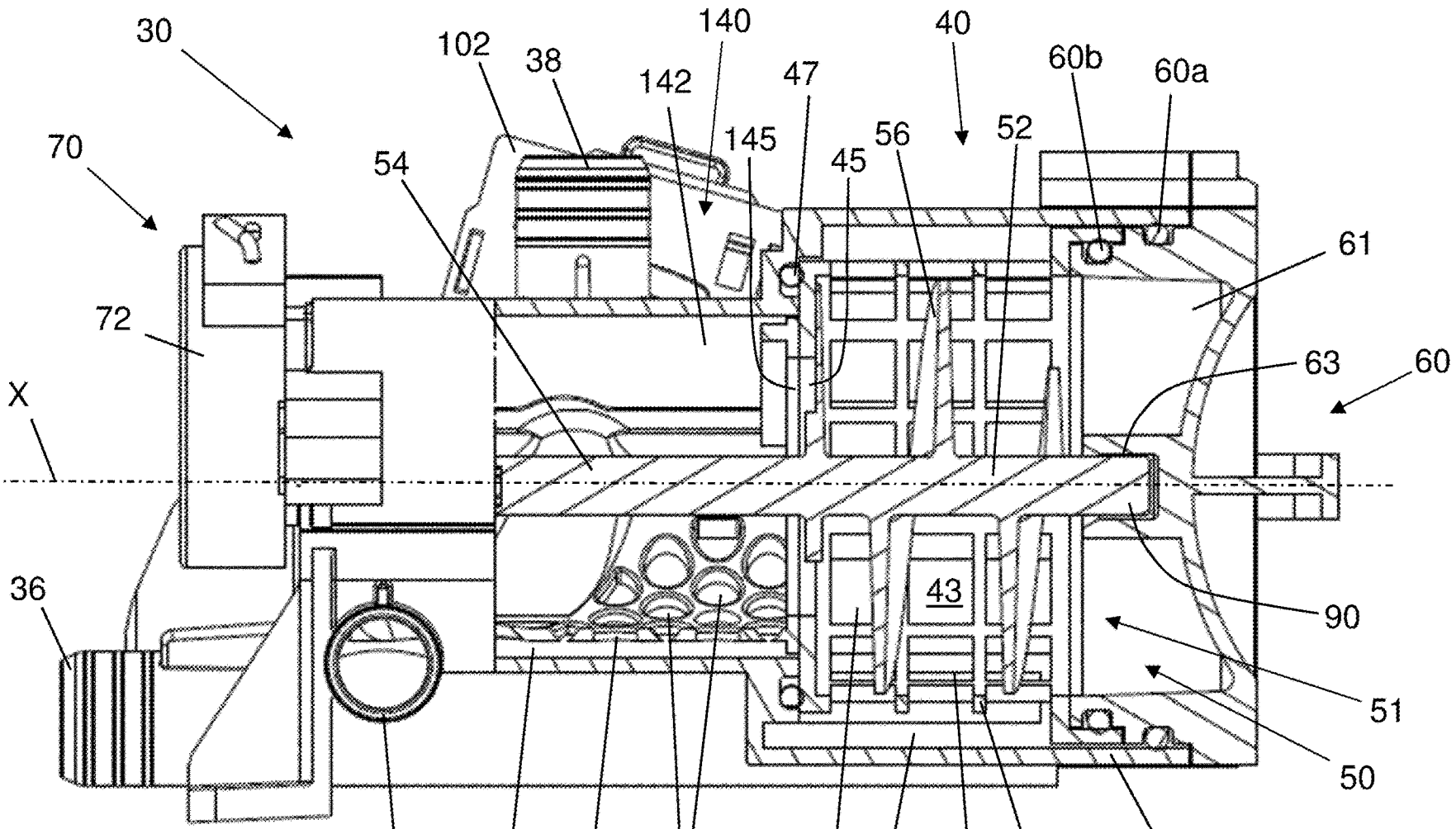
FIG. 10 is a cross section along line X°-X° of the filtering group assembly of FIG. 7.
Figure 11:
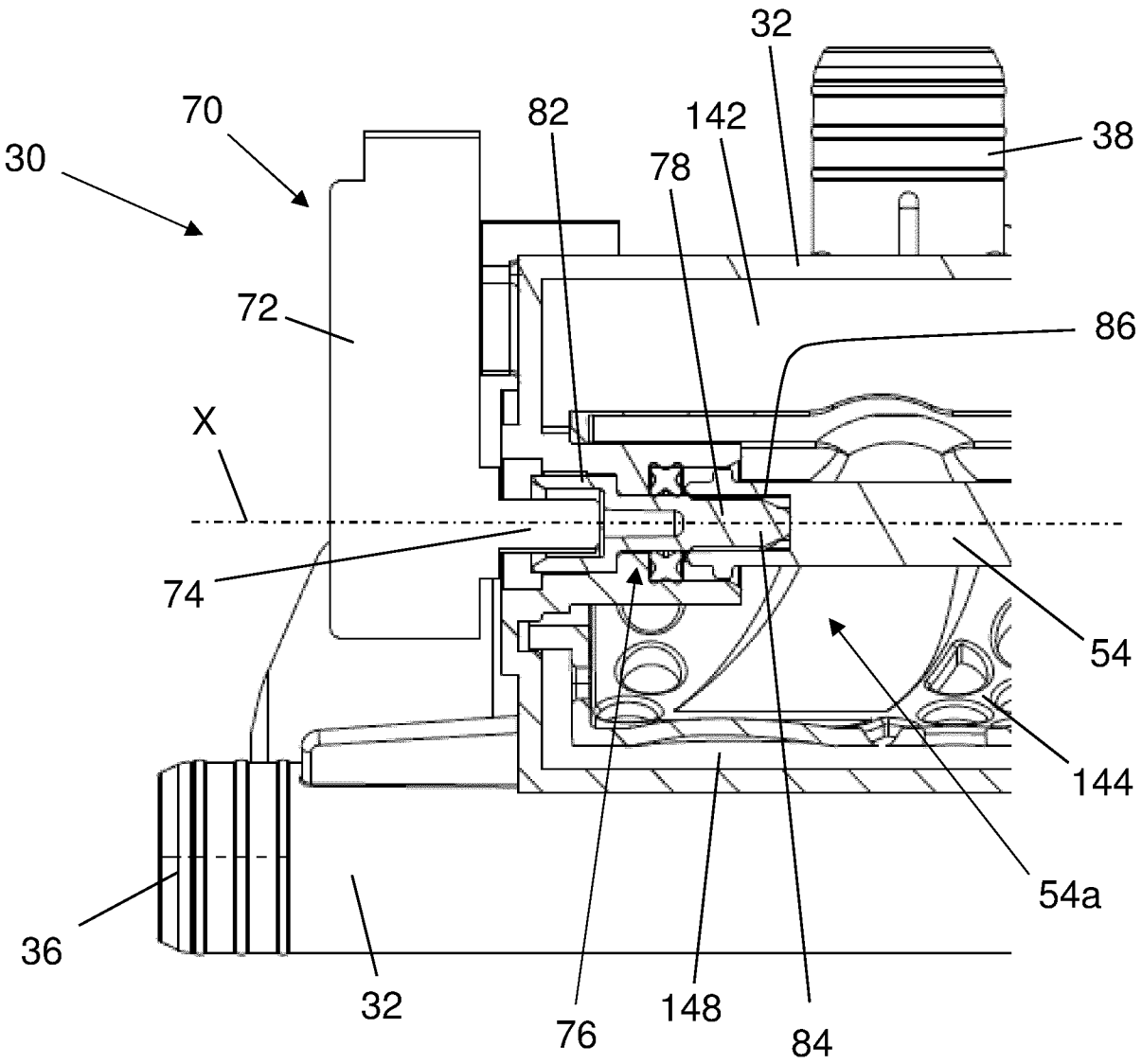
FIG. 11 is a cross section along line XI°-XI° of the filtering group assembly of FIG. 7.

The filtering group assembly 30 preferably comprises a further first outlet 38 for the first recirculation system 100. The first recirculation pump 102 of the first recirculation system 100 is preferably fixedly connected to the housing body 32, more preferably fixedly connected to a volute 32*a* of the housing body 32, as shown in FIG. 9, wherein the volute 32*a* is preferably integrally formed with the housing body 32. Liquid pumped by the first recirculation pump 102 passes through the volute 32*a* and it is then conveyed to the first outlet 38.

In different embodiments, the first recirculation pump may be separated from the housing body of the filtering group assembly and connected thereto via a hose.

The filtering group assembly 30 preferably comprises a further second outlet 39 for the second recirculation system 120. The second outlet 39 is preferably connected to the second recirculation pump 122 of the second recirculation system 120 through the connecting pipe 124. Liquid pumped by the second recirculation pump 122 exits the filtering group assembly 30 through the second outlet 39.

As said above, the filtering group assembly 30 comprises a microparticles filter device 40 for retaining microparticles.

Figure 14:
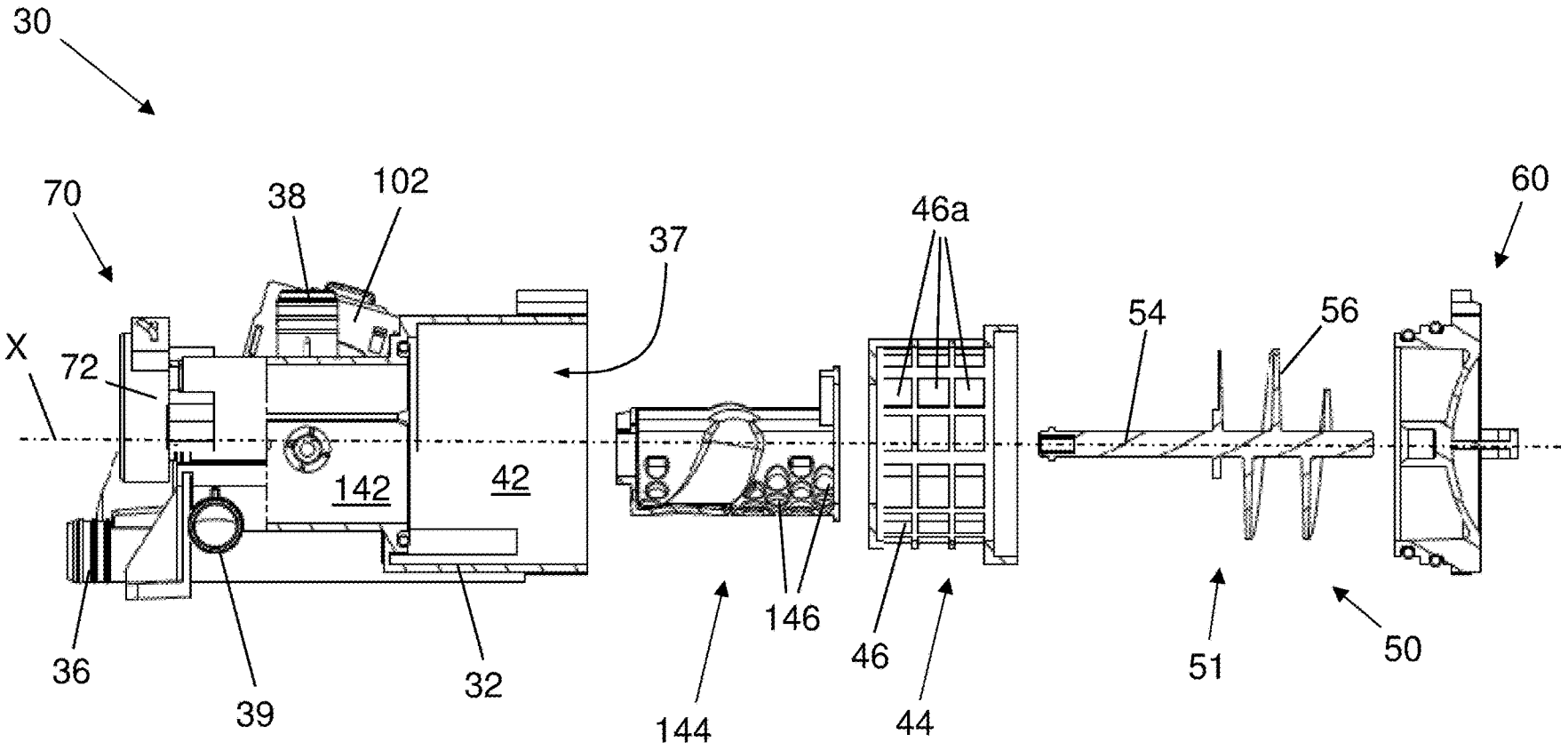

The microparticles filter device 40 comprises a first filtering chamber 42, better visible in FIG. 14, that receives therein a microparticles filter element 44 having a filtering surface 46 at which microparticles accumulate while the liquid flows therethrough.

An amount of the volume encased by the housing body 32 defines the first filtering chamber 42.

The first filtering chamber 42 is thus housed in the housing body 32.

The first filtering chamber 42 is preferably cylindrically shaped and the microparticles filter element 44 preferably has a cylindrical tubular shape. The first filtering chamber 42 and the microparticles filter element 44 preferably extends along said main axis X. The filtering surface 46 preferably comprises a plurality of meshes 46*a*, more preferably rectangular meshes 46*a* (as visible in FIG. 14).

Meshes 46*a* are preferably realized with a woven wire. In a preferred embodiment the wire is made of polyethylene. Said plurality of meshes 46*a* can be provided by one or more layers of woven wire covering a plurality of openings formed in a body portion of the microparticles filter element 44.

Preferably, the mesh is chosen to have a mesh size configured to retain particles having a minimum dimension comprised between 0.1 μm and 5 mm, preferably a minimum dimension comprised between 10 μm and 100 μm, more preferably a minimum dimension comprised between 10 μm and 75 μm, as said above.

The microparticles filter element 44 preferably defines an unfiltered volume 43 apt to receive the liquid before its microfiltration. According to the preferred embodiment here illustrated, the unfiltered volume 43 corresponds to the inner cylindrical volume of the microparticles filter element 44. In a normal operating condition of the microparticles filter device 40, the liquid is supplied into the unfiltered volume 43 and then undergoes to filtration by passing through the microparticles filter element 44, in particular by passing through meshes 46*a*. The filtered liquid thus reaches an elongated annular chamber 48 that is radially outer the microparticles filter element 44 and that forms part of the first filtering chamber 42. The elongated annular chamber 48 hydraulically communicates with the main outlet 36 of the filtering group assembly 30. Hence, the main outlet 36 and the first filtering chamber 42 hydraulically communicates one to the other.

While the liquid flows through the microparticles filter element 44, microparticles progressively accumulate on the filtering surface 46.

The extension of the first filtering chamber 42 along the main axis X substantially corresponds to the filtering area defined by the microparticles filter element 44 and, more preferably, defined by said meshes 46*a*.

Nevertheless, the first filtering chamber 42 may comprise portions that extends outside said filtering area and that are preferably used to assemble the microparticles filter element, for example for receiving sealing elements or for the connection of the microparticles filter element to other parts of the filtering group assembly 30.

As said above, the filtering group assembly 30 comprises an objects filter device 140 for retaining coarse material. The objects filter device 140 is preferably arranged next to the microparticles filter device 40, within the same body element. The objects filter device 140 is arranged upstream the microparticles filter device 40.

The term "upstream" here refers to the flowing direction of the liquid to be filtered that enters the filtering group assembly 30 through the inlet 34 and that reaches the main outlet 36 during the functioning of the washing machine; saying that objects filter device 140 is arranged upstream the microparticles filter device 40 means that during functioning of the draining pump 24 the liquid firstly passes through the objects filter device 140 and then flows into the microparticles filter device 40.

The objects filter device 140 is thus located between the inlet 34 for liquid to be filtered and the microparticles filter device 40.

The objects filter device 140 comprises a second filtering chamber 142, better visible in FIG. 14, that receives therein an objects filter element 144 configured to retain coarse element when liquid flows therethrough.

An amount of the volume encased by the housing body 32 defines the second filtering chamber 142.

The second filtering chamber 142 is thus housed in the housing body 32.

The first filtering chamber 42 and the second filtering chamber 142 are, therefore, housed within the same body element 32.

In the preferred embodiment illustrated herein, the objects filter element 144 is embodied as a hollow half-cylinder provided with apertures 146 having proper size to retain objects having a maximum dimension higher than 5 mm, for example 5 mm diameter circular apertures.

In further preferred embodiments, the objects filter element may be configured differently. For example, the objects filter element may be embodied as a channel through which liquid to be filtered flows and it can be provided with a meandering structure, for example in the form of tabs that are arranged along the channel so as to create a labyrinthic path through which the liquid flows while objects are stopped by the tabs.

The second filtering chamber 142 is preferably cylindrically shaped and the objects filter element 144 preferably has a shape that matches said cylindrical shape, for example half-cylindrically shaped.

The second filtering chamber 142 and the objects filter element 144 preferably extends along the main axis X.

The objects filter element 144 is preferably arranged in the lower/bottom part of the second filtering chamber 142 when the laundry washing machine 1 is in its standing working position.

The objects filter element 144 receives liquid from above, coming from the inlet 34, and then liquid undergoes to filtration by passing through the objects filter element 144 with its apertures 146. The filtered liquid thus reaches an elongated semi-annular chamber 148 that is radially outer the objects filter element 144 and that forms part of the second filtering chamber 142. The elongated semi-annular chamber 148 hydraulically communicates with the first and second outlets 38, 39 associated to the first and second recirculation systems 100, 120. Advantageously, the radial thickness of the semi-annular chamber 148, which is defined by the shorter distance between the second filtering chamber 142 and the objects filter element 144, is dimensioned such that, even in case an object having a predominant extension along a single direction, like a needle for example, can pass through the apertures 146, it will remain entrapped by the semi-annular chamber 148 because its longer dimension will not allow a sufficient movement to pass through said apertures 146 and leaving the second filtering chamber 142. In that way, the semi-annular chamber 148 contribute to create a meandering structure for stopping objects having a maximum dimension higher than 5 mm.

Hence, the first outlet 38 and the second filtering chamber 142 hydraulically communicates one to the other. Analogously, the second outlet 39 and the second filtering chamber 142 hydraulically communicates one to the other.

When the first recirculation system 100 operates, with activation of the first recirculation pump 102, liquid enters the second filtering chamber 142 through the inlet 34, undergoes to filtration action of the objects filter element 144 and then is made circulated through the first recirculation line 104 through the first outlet 38.

Analogously, when the second recirculation system 120 operates, with activation of the second recirculation pump 122, liquid enters the second filtering chamber 142 through the inlet 34, undergoes to filtration action of the objects filter element 144 and then is made circulated through the second recirculation line 126 through the second outlet 39.

The objects filter device 140 thus retain undesirable objects that may damage the first and/or the second recirculation pump 102, 122, for example may damage the impeller in case a centrifugal pump design is used.

The objects filter element 144 of the objects filter device 140 is preferably arranged next to the microparticles filter element 44 of the microparticles filter device 40 in the same housing body 32. More preferably, the objects filter element 144 of the objects filter device 140 is in contact with the microparticles filter element 44 of the microparticles filter device 40.

The objects filter element 144 of the objects filter device 140 and the microparticles filter element 44 of the microparticles filter device 40 preferably communicates through respective apertures 145, 45 facing one the other.

Liquid may hence flow from the second filtering chamber 142 to the first filtering chamber 42 by passing through said apertures 145, 45.

When the draining system 20 operates, with activation of the draining pump 24, liquid enters the second filtering chamber 142 through the inlet 34, passes through said apertures 145, 45, enters the first filtering chamber 42, undergoes to filtration action of the microparticles filter element 44, exits the filtering group assembly 30 through the main outlet 36 and is then drained to the outside through the outlet pipe 26. When liquid enters the second filtering chamber 142 through the inlet 34, substantially the entire flow mass hits the objects filter element 144 without bypassing it. This is achieved by means of the flow direction imparted by the piping-like element provided on the housing body 32 to form the inlet 34.

Advantageously, liquid flowing through the filtering group assembly 30 and discharged to the outside is subjected to the action of the microparticles filter device 40.

Liquid flowing through the filtering group assembly 30 and discharged to the outside of the laundry washing machine 1 is thus subjected to the action of both the objects filter device 140 and the microparticles filter device 40. Liquid circulating inside the laundry washing machine 1 by entering the filtering group assembly 30 through the inlet 34 and exiting the filtering group assembly 30 though either of the two outlets 38, 39 is mainly filtered by the objects filter element 144.

According to an aspect of the invention, the filtering group assembly 30 is equipped with a cleaning device 50 which is configured to remove microparticles that accumulate on the first side of the filtering surface 46 of the microparticles filtering element 44 that the liquid encounters when passing through said filtering surface 46.

The cleaning device 50 is preferably arranged inside the microparticles filter element 44 for moving microparticles it removes from the filtering surface 46 towards a storage volume 61 of a collecting chamber 60. The collecting chamber 60 is arranged at a side, in particular an end side, of the first filtering chamber 42 and in communication therewith.

According to the preferred embodiment described herein, the movable cleaning device 50 comprises a rotatable element 51 wiping a side of the filtering surface 46, preferably wiping the first side of the filtering surface 46 that the liquid encounters and where microparticles accumulates. More preferably, the rotatable element 51 may be embodied as a worm having a central shaft body 52 extending along a main axis X and a helix-shaped element 56 that winds around the central shaft body 52, preferably integrally made with the central shaft body 52.

This main axis X corresponds to the direction through which the rotatable element 51 extends. In the preferred embodiment described herein, this main axis X preferably coincides with the main axis X of the filtering group assembly 30.

The helix-shaped element 56 is preferably a circular helix-shaped element 56.

According to this embodiment, the helix-shaped element 56 substantially defines a helicoid.

In the embodiment described above, the rotatable element 51 is rotated around the main axis X, the helix-shaped element 56 wipes a side of the filtering surface 46 of the microparticles filter element 44 thereby removing microparticles accumulated thereon, and, at the same time, it is able to move microparticles towards the storage volume 61 of the collecting chamber 60, eventually acting as a worm conveyor.

Microparticles are therefore collected into the storage volume 61 of the collecting chamber 60 as the rotatable element 51 rotates. Microparticles removed from the filtering surface 42 are conveyed towards the storage volume 61 of the collecting chamber 60 and towards an opening 37 provided in the housing body 32, such that microparticles can be removed from the microparticles filter device 30 by removing the collecting chamber 60 therefrom.

Advantageously, microparticles moved towards the collecting chamber 60 are pressed in the storage area 61 by the action of helix-shaped element 56.

According to an aspect of the invention, the objects filter device 140 is provided in a position opposite to the collecting chamber 60 and the second filtering chamber 142 of the objects filter device 140 receives a portion 54 of the cleaning device 50 therein. Preferably, the second filtering chamber 142 of the objects filter device 140 receives a portion 54 of the central shaft body 52 of the cleaning device 50.

Advantageously, by arranging the objects filter device 140 opposite to the collecting chamber 60, the filtering group assembly 30 can have room in its internal volume defined by the housing body 32 for placing the cleaning device 50 that interacts with the microparticles filter element 44 to remove microparticles therefrom. Furthermore, the collecting chamber 60, which is supposed to be removed from the laundry washing machine 1 more frequently than what can be foreseen for the objects filter device 140, it is possible to arrange such collecting chamber 60 in a comfortable position for a user interacting with it at the front side wall 2*a* of the laundry washing machine 1.

Still advantageously, by arranging the objects filter device 140 opposite to the collecting chamber 60, a wide area is created on the filtering group assembly 30 to place a plurality of liquid inlet and outlets thereby efficiently designing the liquid flows through the filtering group assembly 30, saving energy needed to power the pumping means for moving such liquid flows.

Then, advantageously, by providing a portion 54 of the cleaning device 50 received in the second filtering chamber 142 of the objects filter device 140 it is possible to use more efficiently the space available inside the housing body 32.

In addition, the presence of a cleaning device portion 54 in the second filtering chamber 142 enhances the possibility that the objects filter device 140 can efficiently block objects preventing them to reach a downstream portion of a draining circuit, for example a pumping device arranged downstream the filtering group assembly 30. For example, an object having a single predominant dimension, like a needle, can be agitated in multiple directions by the combined action of a liquid flow transporting objects to be filtered and the cleaning device portion 54 in the second filtering chamber 142 invested by said flow, so as to be then captured on the objects filter element 144 and maintained inside the second filtering chamber 142.

Rotation of the rotatable element 51 is preferably obtained through an actuating device 70.

The actuating device 70 is preferably provided in a position opposite to the collecting chamber 60, more preferably in a position external to the second filtering chamber 142 and as close as possible to the rotatable element 51.

Advantageously, the actuating device 70 can be arranged at an opposite end portion of the housing body 32 so as to be closer to its power supply and far from user interaction area.

The actuating device 70 is preferably arranged at a first end 54*a* of the central shaft body 52 of the rotatable element 51, preferably at a first end 54*a* of the portion 54 of the central shaft 52 received in the second filter chamber 142. The actuating device 70 preferably comprises an electric motor 72 having a rotatable shaft 74 cooperating with the first end 54*a* of the central shaft body 52 of the rotatable element 51.

An interconnection device 76 is preferably arranged between the first end 54*a* of the central shaft body 52 of the rotatable element 51 and the rotatable shaft 74 of the electric motor 72. The interconnection device 76 allows transmission of rotation of the rotatable shaft 74 to the rotatable element 51 and also allows disconnection of the rotatable element 51 from the rotatable shaft 74 so that the rotatable element 51 may be removed from the first housing body 32, as better described later.

Preferably, the interconnection device 76 comprises a joint element 78 rotatably mounted on the housing body 32 of the filtering group assembly 30. The joint element 78 comprises a first end 82 connected to the shaft 74 of the motor 72 and a second end 84 received in a seat 86 of the central shaft body 52 of the rotatable element 51. The second end 84 of the joint element 78 and the seat 86 of the central shaft body 52 of the rotatable element 51 are complementarily shaped, for example a cylindrical shape with a flat portion is used, so that they can rotate together when the rotatable element 51 works/rotates and they can be disconnected when the rotatable element 51 stops, preferably by extracting the rotatable element 51 when the rotatable element 51 is pulled along the main axis X direction.

According to another aspect of the invention, the collecting chamber 60 is configured to be removably coupled with respect to the housing body 32. The collecting chamber 60 works as a cap for the opening 37, closing the latter when it is coupled to the housing body 32.

According to a preferred embodiment illustrated in FIGS. 7-14, the collecting chamber 60 is preferably removably coupled to the housing body 32 by a mechanical interference and hence the collecting chamber 60 is preferably removably coupled to the housing body 32 by a pushing/pulling action.

In further preferred embodiments, the collecting chamber may be configured to be removably coupled to the housing body by a snap-in action or configured to be screwable to the housing body.

Between the collecting chamber 60 and the housing body 32, sealing elements 60*a*, for example plastic, i.e. polymeric, O-rings, are preferably arranged to guarantee watertightness during the filtering process and also crating mechanical interference.

Between the collecting chamber 60 and the microparticles filter element 44, sealing elements 60*b*, for example plastic, i.e. polymeric, O-rings, are also preferably arranged to further guarantee watertightness during the filtering process and also crating mechanical interference.

According to a further aspect of the invention, the cleaning device 50 comprises a portion 90 extending into the storage volume 61 of the collecting chamber 60 thereby providing an extraction aid member 90 to remove the cleaning device 50 from the housing body 32 when the collecting chamber 60 is removed from the housing body 32, as better described later.

According to the preferred embodiment illustrated in FIGS. 7-14, the portion 90 of the cleaning device 50 extending into the storage volume 61 of the collecting chamber 60 is preferably embodied as a portion 90 that protrudes from the first filtering chamber 42 and extends into the storage volume 61 of the collecting chamber 60. In this embodiment, the cleaning device 50 extends into the storage volume 61 of the collecting chamber 60 along the axis X for the entire storage volume 61 extension along the same axis X. The volume occupied by the cleaning device portion 90 extending inside the storage volume 61 is about 2% of the storage volume where microparticles are accumulated. In different embodiments, not shown in the drawings, the cleaning device 50 may extend into the storage volume 61 along a direction, for example the axis X in the FIGS. 4-7, for only a part of the storage volume extension along the same direction. The cleaning device may thus have a cantilever end portion.

Preferably, the portion 90 is embodied as an extension of the central shaft body 52 of the rotatable element 51.

The portion 90 and the collecting chamber 60 are preferably removably coupled one another. The portion 90 is preferably received in a supporting seat 63 realized in the storage area 61 of the collecting chamber 60.

When the rotatable element 51 rotates, the portion 90 rotates within the supporting seat 63. The supporting seat 63 preferably acts as a centering means while the rotatable element 51 works/rotates.

The supporting seat 63 and the portion 90 are shaped, for example both cylindrically shaped, so that the portion 90 may rotate with respect to the supporting seat 63 when the rotatable element 51 rotates while the collecting chamber 60 may be disengaged from the portion 90 when the collecting chamber 60 is removed from the housing body 32.

The cleaning device 50 and the collecting chamber 60 are therefore preferably removably coupled one another so that the collecting chamber 60 can be disconnected from the cleaning device 50 when the collecting chamber 60 is removed from the housing body 32.

Figure 12:
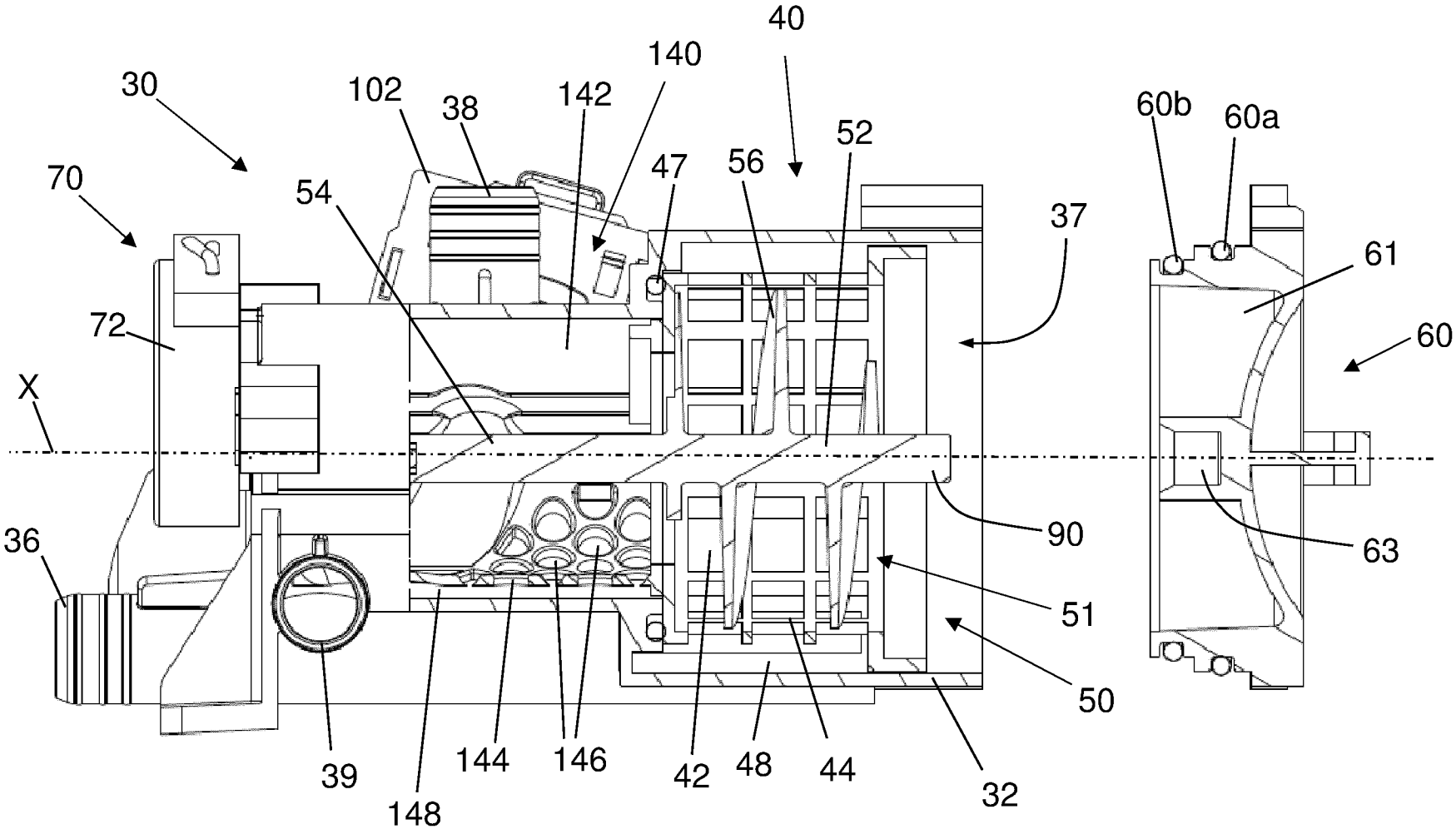
FIGS. 12 to 14 show the filtering group assembly of FIG. 10 in different operating positions.
Figure 13:
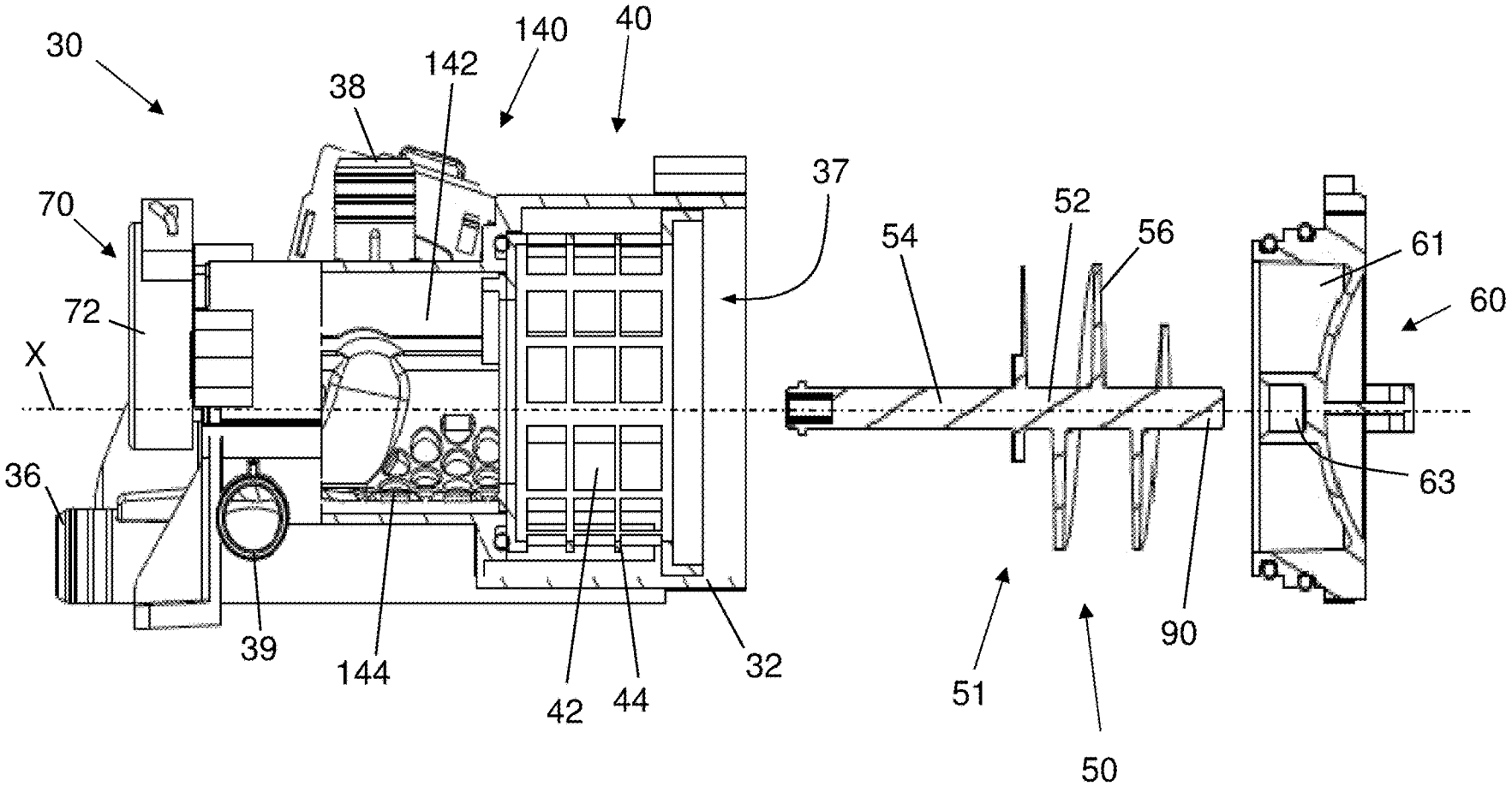

When the collecting chamber 60 is removed from the housing body 32, as illustrated in FIG. 12, the portion 90 provides an extraction aid member 90 to remove the rotatable element 51 from the housing body 32. The rotatable element 51 is hence also advantageously removable from the first and second filtering chambers 42, 142 of respective filter devices 40, 140. In particular, the rotatable element 51 can be removed from the first and second filtering chambers 42, 142 by extracting the rotatable element 51 through the opening 37 of the housing body 32.

The portion 90, in fact, can be usefully grasped by a user and pulled along the main axis X so that the rotatable element 51 disconnects from the joint element 78 and can be fully extracted out of the housing body 32.

Operating position as illustrated in FIG. 12 preferably refers to a maintenance phase of the laundry washing machine 1 when the collecting chamber 60 needs to be removed and then cleaned from microparticles stored in the storage area 61.

As said above, from this operating position the rotatable element 51 may be fully extracted out of the housing body 32 by means of the extraction aid member 90 constituted by the portion 90.

After the rotatable element 51 is fully extracted out of the housing body 32, the microparticles filter element 44 and its filtering surface 46 and the objects filter element 144 of the objects filter device 140 are advantageously accessible from outside. A user may reach the microparticles filter element 44 and its filtering surface 46 and/or the objects filter element 144 of the objects filter device 140 for a proper cleaning process.

More preferably, the microparticles filter element 44 is removably arranged in the first filtering chamber 42 of the microparticles filter device 40. Advantageously, after removal of the collecting chamber 60 the user may also extract the microparticles filter element 44 from the first filtering chamber 42 and hence facilitating the cleaning process and/or substitution of the same in case the microparticles filter element 44 is worn out or damaged, as illustrated for example in the operating position of FIG. 13 or 14. In particular, the microparticles filter element 44 can be extracted from the first filtering chamber 42 through the opening 37 of the housing body 32.

More preferably, the objects filter element 144 is removably arranged in the second filtering chamber 142 of the objects filter device 140. Advantageously, after removal of the collecting chamber 60 and removal of the microparticles filter element 44 of microparticles filter device 40 the user may also extract the objects filter element 144 from the second filtering chamber 142 of the objects filter device 140 and hence facilitating the cleaning process and/or substitution of the same in case the objects filter element 144 is damaged, as illustrated for example in the operating position of FIG. 14. In particular, the objects filter device 140 can be extracted from the second filtering chamber 142 through the opening 37 of the housing body 32.

Between the microparticles filter element 44 of the microparticles filter device 40 and the housing body 32, a sealing element 47, for example plastic, i.e. polymeric, O-ring, is preferably arranged to guarantee watertightness of the first filtering chamber 42 during the filtering process.

The microparticles filter element 44 preferably extends towards the frontal part of the housing body 32 of the microparticles filter device 40 and preferably receives a portion of the collecting chamber 60 therein.

This facilitates extraction of the microparticles filter element 44 which may be grasped by the user after removal of the collecting chamber 60.

As said above, the collecting chamber 60 is configured to be removably coupled with respect to the housing body 32 and in the preferred embodiment illustrated in FIGS. 7-14 the collecting chamber 60 is connected through mechanical interference to the housing body 32. In further preferred embodiments, not illustrated, the collecting chamber may be removably coupled with respect to the housing body not directly coupling the collecting chamber to the housing body.

For example, the collecting chamber may be removably coupled, e.g. screwable, to the frontal part of the microparticles filter element 44 instead of to the housing body 32.

In a preferred embodiment illustrated herein, the cabinet 2 comprises an aperture 7, as shown in FIG. 1, so that the collecting chamber 60 and, in case, the filter elements 44, 144 of the microparticles filter device 30 are accessible, from outside, to a user.

The aperture 7 is preferably realized in the lower right side of the front side wall 2*a* of the laundry washing machine 1 and aligned with the filtering group assembly 30.

The cabinet 2 then preferably comprise an openable door 13 associated to the aperture 7 to give access thereto.

According to the preferred embodiment described above, the microparticles filter element 44 of the microparticles filter device 40 and the objects filter element 144 of the objects filter device 140 are two separated elements preferably connected one next to the other and in contact therebetween. In further preferred embodiments, the microparticles filter element of the microparticles filter device and the objects filter element of the objects filter device may be realized as an integral single body. This simplifies extraction of the filter elements from the housing body or their insertion into the housing body.

Figure 15:
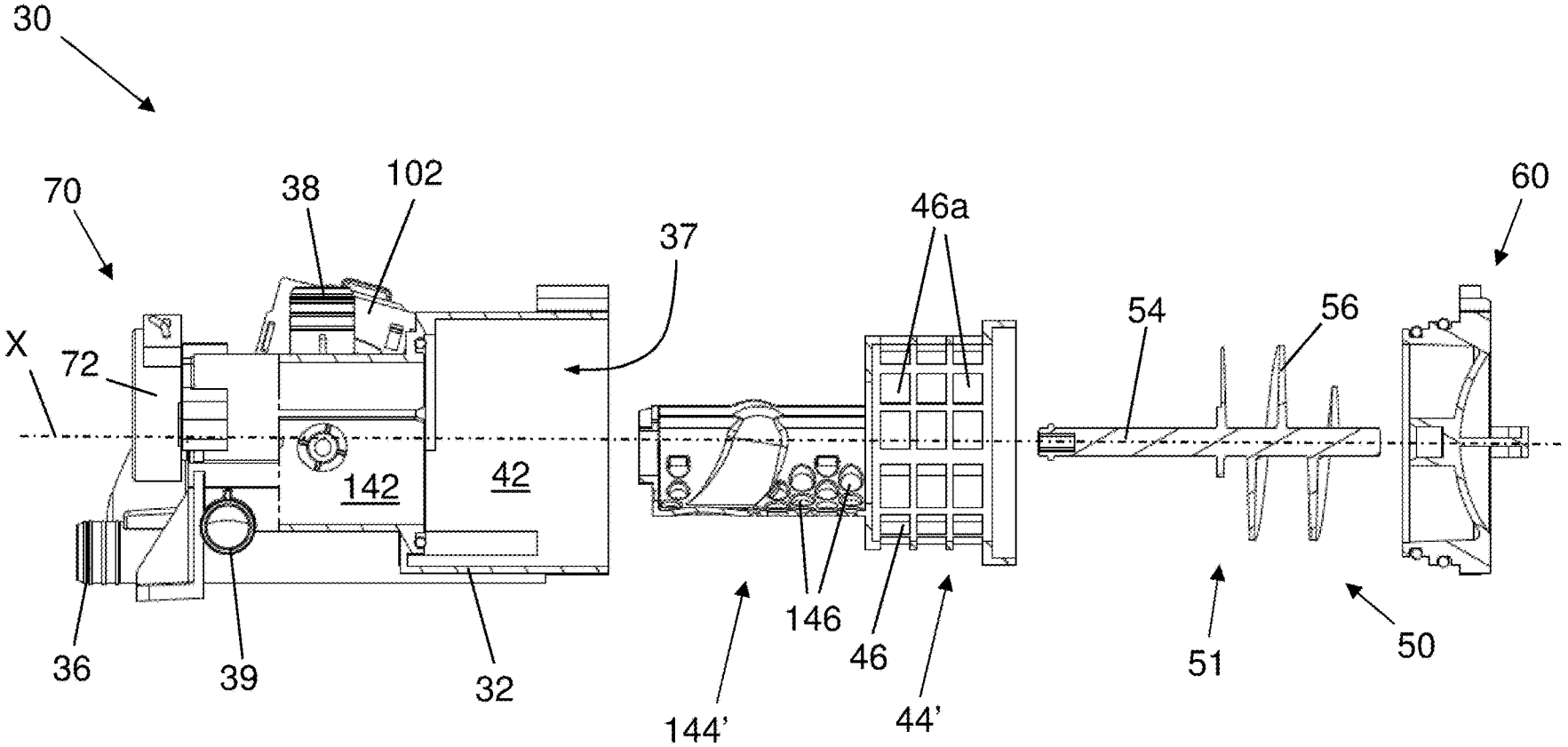
FIG. 15 shows a further embodiment of the filtering group assembly of FIG. 14.

FIG. 15 shows a solution of this type. In the drawing, corresponding characteristics and/or components of the embodiment previously described are identified by the same reference numbers.

Here, the microparticles filter element 44' of the microparticles filter device 40 and the objects filter element 144' of the objects filter device 140 are realized as an integral single body. This simplifies extraction of the filter elements 44', 144' from the housing body 32 or their insertion into the housing body 32.

Figure 16:
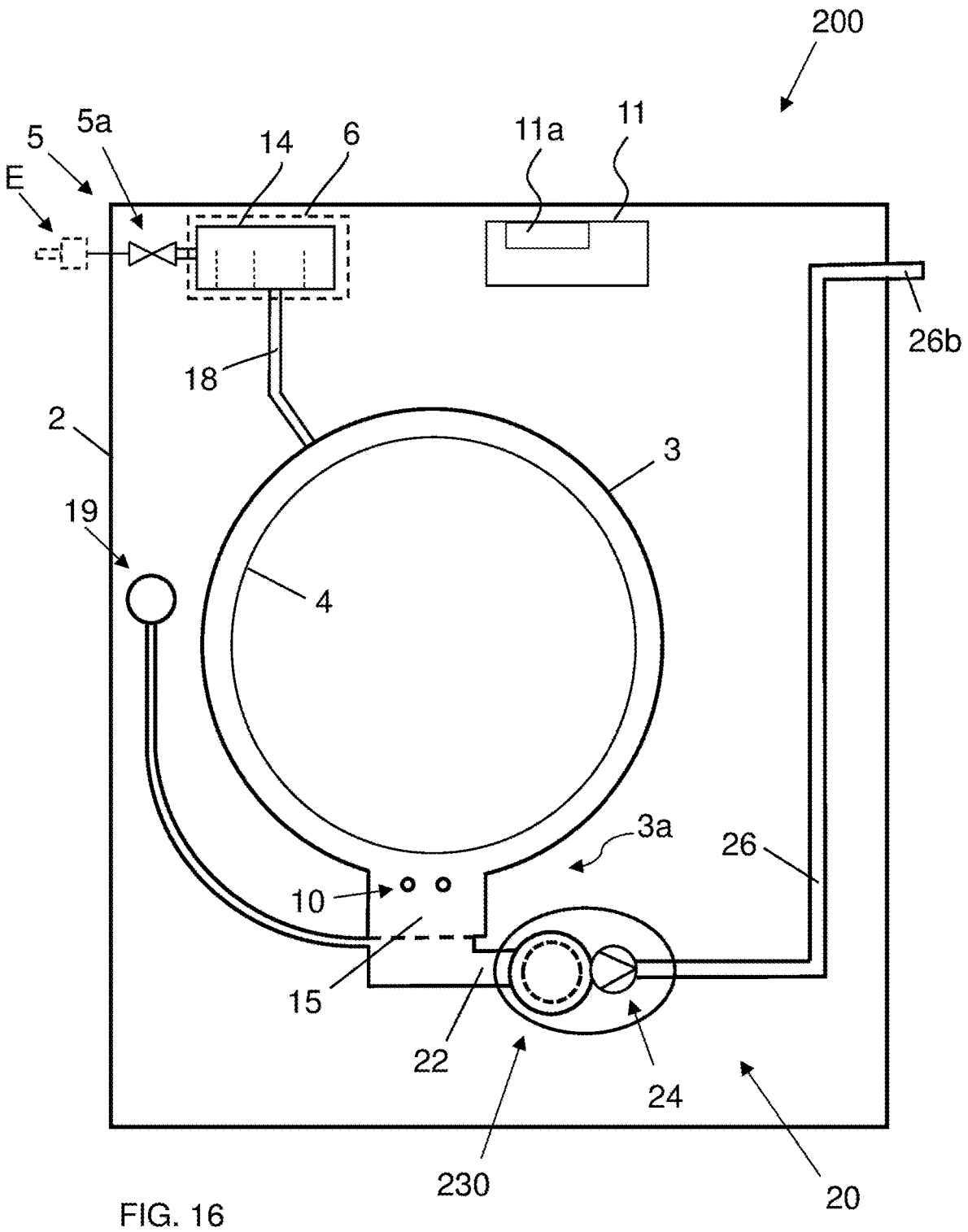
FIG. 16 shows a schematic view of the laundry washing machine of the invention according to a further embodiment of the invention.
Figure 17:
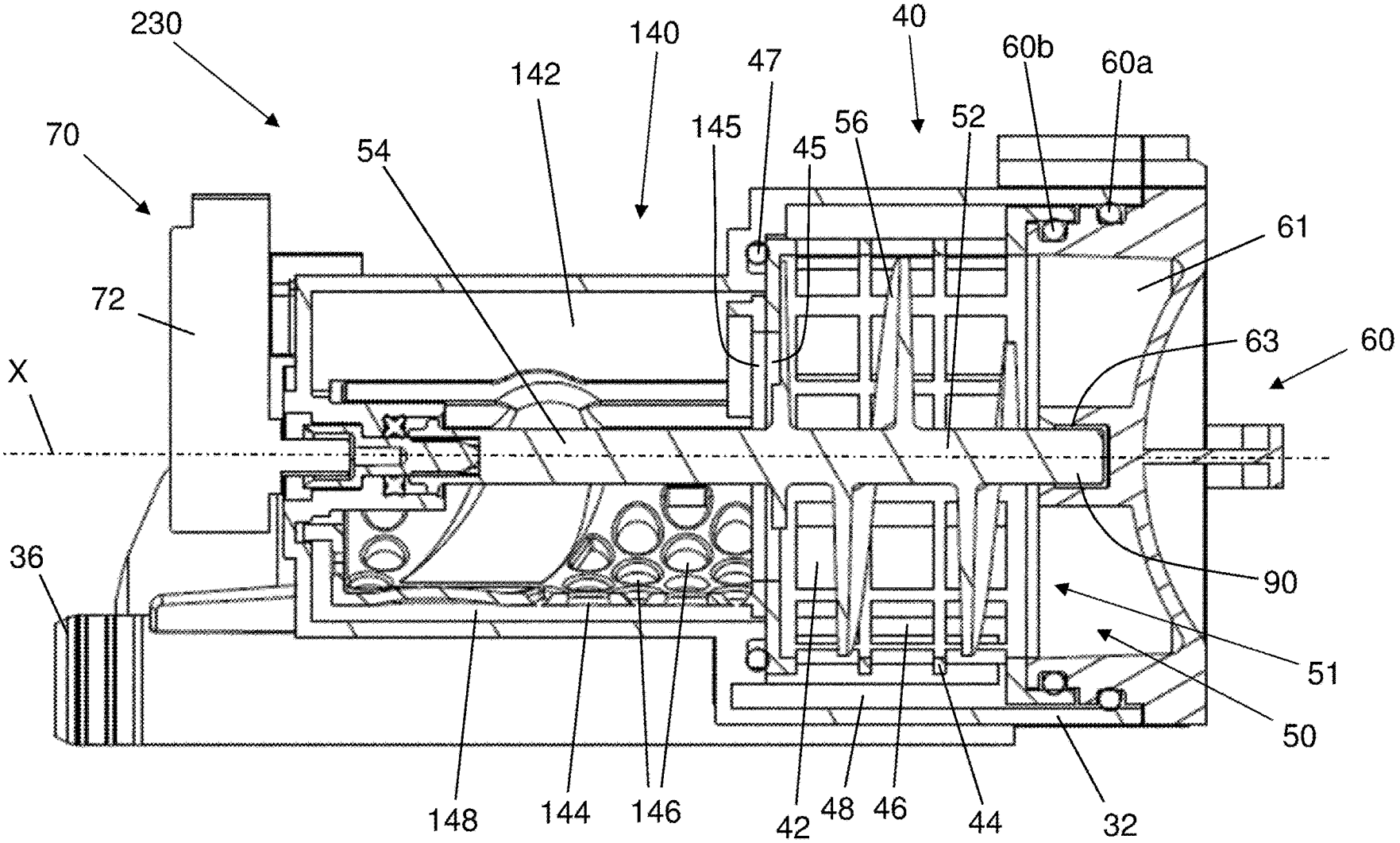
FIG. 17 shows a cross section of the filtering group assembly for the laundry washing machine of FIG. 16.

FIG. 16 shows a schematic view of a further preferred embodiment of a laundry washing machine 200 according to the invention and FIG. 17 show the cross section of filtering group assembly 230 used in said laundry washing machine 200.

In the drawings, corresponding characteristics and/or components of the embodiment described in FIGS. 1-14 are identified by the same reference numbers.

This further preferred embodiment of the invention differs from the preferred embodiment previously described with reference to FIGS. 1 to 14 in that the laundry washing machine 200 comprises a draining system 20 but it is not provided with any recirculation system. The filtering group assembly 230 is arranged between the main discharging pipe 22 and the draining pump 24 of the draining system 20.

The filtering group assembly 230 differs from the preferred embodiment previously described with reference to FIGS. 1 to 14 in that it comprises only a main outlet 36 for the connection to the draining pump 24 while there are no other additional outlets.

When the draining system 20 operates, with activation of the draining pump 24, liquid enters the second filtering chamber 142 through the inlet 34, passes through said apertures 145, 45, enters the first filtering chamber 42, undergoes to filtration action of the microparticles filter element 44, exits the filtering group assembly 30 through the main outlet 36 and is then drained to the outside through the outlet pipe 26.

Advantageously, as described above, liquid circulates inside the second filtering chamber 142 before it reaches the first filtering chamber 42 and hence it undergoes to the filtration action of the objects filter element 144 of the objects filter device 140. Liquid flowing through the filtering group assembly 30 and discharged to the outside is thus subjected to the action of both the objects filter device 140 and the microparticles filter device 40.

It has thus been shown that the present invention allows all the set objects to be achieved. In particular, the invention makes possible to provide a laundry washing machine that reduces constructional complexity of the filtering system and makes maintenance operations more comfortable compared to known laundry washing machines.

While the present invention has been described with reference to particular embodiments shown in the figures, it should be noted that the present invention is not limited to the specific embodiments illustrated and described herein; on the contrary, further variants of the embodiments described herein fall within the scope of the present invention, which is defined in the appended claims.

The invention claimed is:

1. A laundry washing machine comprising:

an outer cabinet;

a washing tub containing a washing drum suited to receive the laundry to be washed;

a liquid supply system suitable to convey liquid to the washing tub;

a draining system to drain liquid outside the outer cabinet;

a filtering group assembly arranged in a flow path between the liquid supply system and the draining system, the filtering group assembly comprising:

a housing body;

an inlet for liquid to be filtered;

a microparticles filter device comprising a first filtering chamber housed in the housing body, the first filtering chamber comprising a microparticles filter element having a filtering surface on which microparticles accumulate while the liquid flows therethrough;

a main outlet for filtered liquid hydraulically communicating with the first filtering chamber; and a cleaning device movably arranged in the first filtering chamber for removing microparticles that accumulate on the filtering surface, the cleaning device moving microparticles removed from the filtering surface towards a storage volume of a collecting chamber arranged at a side of the first filtering chamber and in communication therewith;

wherein the filtering group assembly comprises an objects filter device comprising a second filtering chamber housed in the housing body, the second filtering chamber comprising an objects filter element for stopping objects contained in the liquid to be filtered when the liquid flows therethrough, wherein the objects filter device is provided in a position opposite to the collecting chamber and located between the inlet and the microparticles filter device, the second filtering chamber receiving a portion of the cleaning device therein.

2. The laundry washing machine according to claim 1, wherein the microparticles filter device is a filter suitable to filter particles having a minimum dimension ranging from 0.1 μm and 5 mm.

3. The laundry washing machine according to claim 1, wherein the objects filter device is a filter suitable to filter objects having a maximum dimension greater than 5 mm.

4. The laundry washing machine according to claim 1, wherein the filtering group assembly is arranged in the draining system.

5. The laundry washing machine according to claim 1, wherein the liquid supply system includes at least one recirculation system for draining liquid from a bottom region of the washing tub to a second region of the washing tub, the at least one recirculation system comprising a recirculation pump arranged downstream the filtering group assembly and the filtering group assembly comprising a further outlet operatively connected to the recirculation pump.

6. The laundry washing machine according to claim 5, wherein the further outlet hydraulically communicates with the second filtering chamber.

7. The laundry washing machine according to claim 1, wherein the collecting chamber is configured to be removably coupled the housing body.

8. The laundry washing machine according to claim 1, wherein the cleaning device comprises at least a portion extending into the storage volume of the collecting chamber thereby providing an extraction aid member to remove the cleaning device from the housing body when the collecting chamber is removed from the housing body.

9. The laundry washing machine according to claim 1, wherein the microparticles filter element is removably arranged in the first filtering chamber and/or the objects filter element of the objects filter device is removably arranged in the second filtering chamber.

10. The laundry washing machine according to claim 1, wherein the cleaning device is configured to be removably coupled to the first filtering chamber and the second filtering chamber.

11. The laundry washing machine according to claim 1, wherein the cleaning device comprises a rotatable element configured to remove microparticles that accumulate on the filtering surface of the microparticles filter element.

12. The laundry washing machine according to claim 11, wherein the rotatable element comprises a worm comprising a central shaft body and a helix-shaped element winding around the central shaft body.

13. The laundry washing machine according to claim 1, further comprising an actuating device for moving the cleaning device.

14. The laundry washing machine according to claim 13, wherein the actuating device is provided in a position opposite to the collecting chamber.

15. The laundry washing machine according to claim 1, wherein the cleaning device and the collecting chamber are removably coupled one another, so that when the collecting chamber is removed from the housing body the collecting chamber is disconnected from the cleaning device.

16. The laundry washing machine according to claim 1, wherein the outer cabinet further comprises an aperture so that the collecting chamber of the microparticles filter device is accessible therefrom.

17. The laundry washing machine according to claim 16, wherein the outer cabinet further comprises an openable door associated to the aperture.

18. The laundry washing machine according to claim 1, wherein the microparticles filter element is a disposable filter element.

19. A laundry washing machine comprising:

an outer cabinet;

a washing tub containing a washing drum suited to receive the laundry to be washed;

a liquid supply system suitable to convey liquid to the washing tub;

a draining system to drain liquid outside the outer cabinet;

a filtering group assembly arranged in a flow path between the liquid supply system and the draining system, the filtering group assembly comprising:

a housing body;

an inlet for liquid to be filtered;

a microparticles filter device comprising a first filtering chamber housed in the housing body, the first filtering chamber comprising a microparticles filter element having a filtering surface on which microparticles accumulate while the liquid flows therethrough;

a main outlet for filtered liquid hydraulically communicating with the first filtering chamber; and a cleaning device movably arranged in the first filtering chamber for removing microparticles that accumulate on the filtering surface, the cleaning device moving microparticles removed from the filtering surface towards a storage volume of a collecting chamber arranged at a side of the first filtering chamber and in communication therewith;

wherein the filtering group assembly comprises an objects filter device comprising a second filtering chamber housed in the housing body, the second filtering chamber comprising an objects filter element for stopping objects contained in the liquid to be filtered when the liquid flows therethrough, wherein the objects filter device is provided in a position opposite to the collecting chamber and located between the inlet and the microparticles filter device, the second filtering chamber receiving a portion of the cleaning device therein, and wherein the cleaning device comprises at least a portion extending into the storage volume of the collecting chamber thereby providing an extraction aid member to remove the cleaning device from the housing body when the collecting chamber is removed from the housing body.

20. A laundry washing machine comprising:

an outer cabinet;

a washing tub containing a washing drum suited to receive the laundry to be washed;

a liquid supply system suitable to convey liquid to the washing tub;

a draining system to drain liquid outside the outer cabinet;

a filtering group assembly arranged in a flow path between the liquid supply system and the draining system, the filtering group assembly comprising:

a housing body;

an inlet for liquid to be filtered;

a microparticles filter device comprising a first filtering chamber housed in the housing body, the first filtering chamber comprising a microparticles filter element having a filtering surface on which microparticles accumulate while the liquid flows therethrough;

a main outlet for filtered liquid hydraulically communicating with the first filtering chamber; and a cleaning device movably arranged in the first filtering chamber for removing microparticles that accumulate on the filtering surface, the cleaning device moving microparticles removed from the filtering surface towards a storage volume of a collecting chamber arranged at a side of the first filtering chamber and in communication therewith;

wherein the filtering group assembly comprises an objects filter device comprising a second filtering chamber housed in the housing body, the second filtering chamber comprising an objects filter element for stopping objects contained in the liquid to be filtered when the liquid flows therethrough, wherein the objects filter device is provided in a position opposite to the collecting chamber and located between the inlet and the microparticles filter device, the second filtering chamber receiving a portion of the cleaning device therein, and wherein the cleaning device comprises a rotatable element configured to remove microparticles that accumulate on the filtering surface of the microparticles filter element.

* * * * *